US011808543B2

(12) United States Patent
Yehle

(10) Patent No.: US 11,808,543 B2
(45) Date of Patent: Nov. 7, 2023

(54) CROSSOVER CROSSBOW

(71) Applicant: Ravin Crossbows, LLC, Superior, WI (US)

(72) Inventor: Craig Thomas Yehle, Winona, MN (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

(21) Appl. No.: 17/543,467

(22) Filed: Dec. 6, 2021

(65) Prior Publication Data

US 2022/0178646 A1 Jun. 9, 2022

Related U.S. Application Data

(60) Provisional application No. 63/122,471, filed on Dec. 7, 2020.

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123
See application file for complete search history.

(56) References Cited

U.S. PATENT DOCUMENTS 6,095,128 A 8/2000 Bednar
6,874,491 B2 4/2005 Bednar
7,305,979 B1 12/2007 Yehle
7,328,693 B2 2/2008 Kempf
7,823,572 B2 11/2010 Anderson
7,832,386 B2 11/2010 Bednar et al.
7,836,871 B2 11/2010 Kempf
7,891,348 B2 2/2011 Colley
8,573,192 B2 11/2013 Bednar
8,770,178 B2 7/2014 Kempf
9,335,115 B2 5/2016 Bednar
10,209,026 B2 2/2019 Yehle
2010/0170488 A1 7/2010 Rasor et al.
(Continued)

OTHER PUBLICATIONS

The International Search Report and Written Opinion for PCT App. No. PCT/US21/62143, dated Mar. 18, 2022.
(Continued)

*Primary Examiner* — John A Ricci
(74) *Attorney, Agent, or Firm* — Foley & Lardner LLP

(57) ABSTRACT

A crossbow includes a frame, a riser coupled to the frame, a first flexible limb, a second flexible limb, a third flexible limb, and a fourth flexible limb. A first cam assembly couples to the first flexible limb and the second limb and includes a first draw string journal, a first power cable journal, and a second power cable journal. A second cam assembly couples to the third flexible limb and the fourth flexible limb and includes a second draw string journal, a third power cable journal, and a fourth power cable journal. A draw string is received in the first draw string journal and the second draw string journal. Power cables cross over the center rail, above and below the draw string, and are received in the first power cable journal, the second power cable journal, the third power cable journal, and the fourth power cable journal, respectively.

19 Claims, 21 Drawing Sheets

(56) References Cited

U.S. PATENT DOCUMENTS

| | | | | |
|---|---|---|---|---|
| 2013/0213371 | A1* | 8/2013 | Biafore, Jr. | F41B 5/1403 124/25 |
| 2014/0261357 | A1* | 9/2014 | McPherson | F41B 5/105 124/25 |
| 2015/0013654 | A1 | 1/2015 | Bednar | |
| 2018/0051955 | A1 | 2/2018 | Yehle | |
| 2018/0172388 | A1* | 6/2018 | Haynes | F41B 5/148 |
| 2018/0274878 | A1* | 9/2018 | McPherson | F41B 5/123 |
| 2019/0137212 | A1 | 5/2019 | Yehle | |
| 2020/0011632 | A1* | 1/2020 | Chang | F41B 5/105 |

OTHER PUBLICATIONS

BestCrossbowSource.com dated Jul. 15, 2015, 5 pages (Crossbow Reviews and Guidelines).

* cited by examiner

CROSSOVER CROSSBOW

REFERENCE TO RELATED APPLICATIONS

This application claims priority to U.S. Provisional Application No. 63/122,471, filed Dec. 7, 2020, entitled "Efficient Crossover Crossbow," the entirety of which is herein incorporated by reference.

FIELD OF THE INVENTION

The present disclosure is directed to crossbows of the type having limb mounted cams and power cables that cross over the centerline of the crossbow and connect to the cams.

BACKGROUND OF THE INVENTION

Bows have been used for many years as a weapon for hunting and target shooting. More advanced bows include cams that increase the mechanical advantage associated with the draw of the draw string. The cams are configured to yield a decrease in draw force near full draw. Such cams preferably use power cables that load the bow limbs. Power cables can also be used to synchronize rotation of the cams, such as disclosed in U.S. Pat. No. 7,305,979 (Yehle).

With conventional bows and crossbows the draw string is typically pulled away from the generally concave area between the limbs and away from the riser and limbs. This design limits the power stroke for bows and crossbows.

In order to increase the power stroke, the draw string can be positioned on the down-range side of the string guides so that the draw string unrolls between the string guides toward the user as the bow is drawn, such as illustrated in U.S. Pat. No. 7,836,871 (Kempf) and U.S. Pat. No. 7,328,693 (Kempf). One drawback of this configuration is that the power cables can limit the rotation of the cams to about 270 degrees. In order to increase the length of the power stroke, the diameter of the cams needs to be increased. However, increasing the size of the cams is conventionally understood to be practical in a larger and less usable crossbows.

FIGS. 1-3 illustrate a portion of a barrel 12 of a crossbow 10, and limbs 14 and 16 connected to barrel 12 by way of a riser 18. The string guide system 18 includes power cables 20A, 20B ("20") attached to respective string guides 22A, 22B ("22") at first attachment points 24A, 24B ("24"). The second ends 26A, 26B ("26") of the power cables 20 are attached to the axles 28A, 28B ("28") of the opposite string guides 22. Draw string 30 engages down-range edges 46A, 46B of string guides 22 and is attached at draw string attachment points 44A, 44B ("44")

As the draw string 30 is moved from released configuration 32 of FIG. 1 to drawn configuration 34 of FIGS. 2 and 3, the string guides 22 counter-rotate toward each other about 270 degrees. The draw string 30 unwinds between the string guides 22 from opposing cam journals 48A, 48B ("48") in what is referred to as a reverse draw configuration. As the first attachment points 24 rotate in direction 36, the power cables 20 are wrapped around respective power cable take-up journal of the string guides 22, which in turn bends limbs 14 and 16 toward each other to store the energy needed for the bow to fire the arrow.

Further rotation of the string guides 22 in the direction 36 causes the power cables 20 to contact the power cable take-up journal, stopping rotation of the cam. The first attachment points 24 may also contact the power cables 20 at the locations 38A, 38B ("38"), preventing further rotation in the direction 36. As a result, rotation of the string guides 22 is limited to about 270 degrees, reducing the length 40 of the power stroke.

Crossbows with cams mounted on the limbs are also limited by the fact that some of the potential energy stored in the limbs is consumed in accelerating the mass of the cams and pulleys, and hence, not transmitted to the arrow. One portion of this potential energy is used to accelerate the cams apart from each other in an axial direction so that the cams are moved with the movement of the limb tips. Another portion of this potential energy is used to rotate the cams and pulleys from an initial static position through a range of string winding positions within a very short period of time. A further portion of the potential energy released from the limbs during firing accelerates the mass of the bow string between cams in a forward direction to launch the arrow.

Accordingly, as the arrow separates from the draw string the cams are rotated rapidly and therefore have a rotational inertia that acts to continue to tighten the bowstring onto the cams. At the same time the forward movement of the bowstring is rapidly stopped as the draw string tightens. The draw string reacts by oscillating. This oscillation helps to dissipate the inertial energy stored in the draw string. In part this is accomplished by transferring energy from the oscillating draw string into air surrounding the draw string. This creates noise. However, the draw string does not have an unlimited amount of time to release this energy as the cams rapidly tighten the draw string in part as they exhaust their inertial energy. This causes the draw string to release much of the inertial energy over a very short period of time creating a loud sound.

It will be appreciated that as crossbows are developed to fire faster, the inertial energy levels in the draw string, and in the cams increase thus the draw string is required to release stored inertial energy over a shorter period of time increasing the sound generated by the draw string.

It will also be appreciated that dampening the inertial energy of the draw strings and the cams adds stresses, shock and vibrations to mountings and strings that can influence performance over time.

What is needed therefore is a more efficient crossbow system that limits losses of limb energy and provides a quieter high speed crossbow or other bow.

BRIEF SUMMARY OF THE INVENTION

In one aspect of the invention, a crossbow includes a string latch configured to hold a draw string and a nocked arrow within a firing plane; a center rail providing an arrow support configured to position one end of the nocked arrow along the firing plane; a frame coupled to the center rail; a riser coupled to the frame, the riser configured to: position fixed ends of a first flexible upper side limb and a second flexible upper side limb such that free ends of the first flexible upper side limb and the second flexible upper side limb flex along an upper plane disposed vertically above the firing plane, and position fixed ends of a first flexible lower side limb and a second flexible lower side limb such that free ends of the first flexible lower side limb and the second flexible lower side limb flex along a lower plane disposed vertically below the firing plane; a first cam assembly coupling the free ends of the first flexible upper side limb and the first flexible lower limb on a first side of the center rail, the first cam assembly including: a first draw string path substantially co-planar with the firing plane, a first upper string journal disposed vertically above the first draw string path, and a first lower string journal disposed vertically below the first draw string path; a second cam assembly coupling the free ends of the second flexible upper side limb and the second flexible lower side limb on a second side of the center rail, the second cam assembly including: a second draw string path substantially co-planar with the firing plane, a second upper string journal disposed above the second draw string path, and a second lower string journal disposed below the second draw string path; a draw string having a first end coupled to the first cam assembly along the first draw string path, and a second end coupled to the second cam assembly along the second draw string path, the draw string extending across the center rail along the firing plane; a first upper power cable having a first end operatively coupled to the first upper string journal, and a second end operatively coupled to the free end of the second flexible upper side limb, the first upper power cable extending vertically above the center rail and the firing plane; a second upper power cable having a first end operatively coupled to the second upper string journal, and a second end operatively coupled to the free end of the first flexible upper side limb, the second upper power cable extending vertically above the center rail and the firing plane; a first lower power cable having a first end operatively coupled to the first lower string journal, and a second end operatively coupled to the free end of the second flexible lower side limb, the first lower power cable extending vertically below the center rail and the firing plane; and a second lower power cable having a first end operatively coupled to the second lower string journal, and a second end operatively coupled to the free end of the first flexible lower side limb, the second lower power cable extending vertically below the center rail and the firing plane.

In another aspect of the invention, a crossbow includes a center rail configured to receive an arrow; a frame coupled to the center rail; a riser coupled to the frame; a first flexible limb located on a first side of the frame, the first flexible limb including a first end coupled to the riser and a second end spaced apart from the first end; a second flexible limb located on the first side of the frame, the second flexible limb including a second end coupled to the riser and a fourth end spaced apart from the third end; a third flexible limb located on a second side of the frame, the third flexible limb including a fifth end coupled to the riser and a sixth end spaced apart from the fifth end; a fourth flexible limb located on the second side of the frame, the fourth flexible limb including a seventh end coupled to the riser and an eighth end spaced apart from the seventh end; a first cam assembly coupled to the first flexible limb at the second end and the second flexible limb at the fourth end, the first cam assembly including: a first draw string journal, a first power cable journal disposed on a first side of the first draw string journal, and a second power cable journal disposed on a second side of the second draw string journal; a second cam assembly coupled to the third flexible limb at the fifth end and the fourth flexible limb at the eighth end, the second cam assembly including: a second draw string journal, a third power cable journal disposed on a first side of the second draw string journal, and a fourth power cable journal disposed on a second side of the second draw string journal; a draw string at least partially received in the first draw string journal and the second draw string journal; a first power cable coupled to the second end of the first flexible limb and received at least partially within the third power cable journal; a second power cable coupled to the sixth end of the third flexible limb and received at least partially within the first power cable journal; a third power cable coupled to the fourth end of the second flexible limb and received at least partially within the fourth power cable journal; and a fourth power cable coupled to the eighth end of the fourth flexible limb and received at least partially within the second power cable journal.

In a further aspect of the invention, a crossbow includes a frame; a riser coupled to the frame; a first flexible limb including a first end coupled to the riser; a second flexible limb including a second end coupled to the riser; a third flexible limb including a third end coupled to the riser; a fourth flexible limb including a fourth end coupled to the riser; a first cam assembly coupled to the first flexible limb and the second flexible limb, the first cam assembly including: a first draw string journal, a first power cable journal disposed on a first side of the first draw string journal, and a second power cable journal disposed on a second side of the second draw string journal; a second cam assembly coupled to the third flexible limb and the fourth flexible limb, the second cam assembly including: a second draw string journal, a third power cable journal disposed on a first side of the second draw string journal, and a fourth power cable journal disposed on a second side of the second draw string journal; a draw string at least partially received in the first draw string journal and the second draw string journal; a first power cable that crosses over the center rail vertically above the draw string, the first power cable being coupled to the first flexible limb and received at least partially within the third power cable journal; a second power cable that crosses over the center rail vertically above the draw string, the second power cable being coupled to the third flexible limb and received at least partially within the first power cable journal; a third power cable that crosses over the center rail vertically below the draw string, the third power cable being coupled to the second flexible limb and received at least partially within the fourth power cable journal; and a fourth power cable that crosses over the center rail vertically below the draw string, the fourth power cable being coupled to the fourth flexible limb and received at least partially within the second power cable journal.

Figure 1:
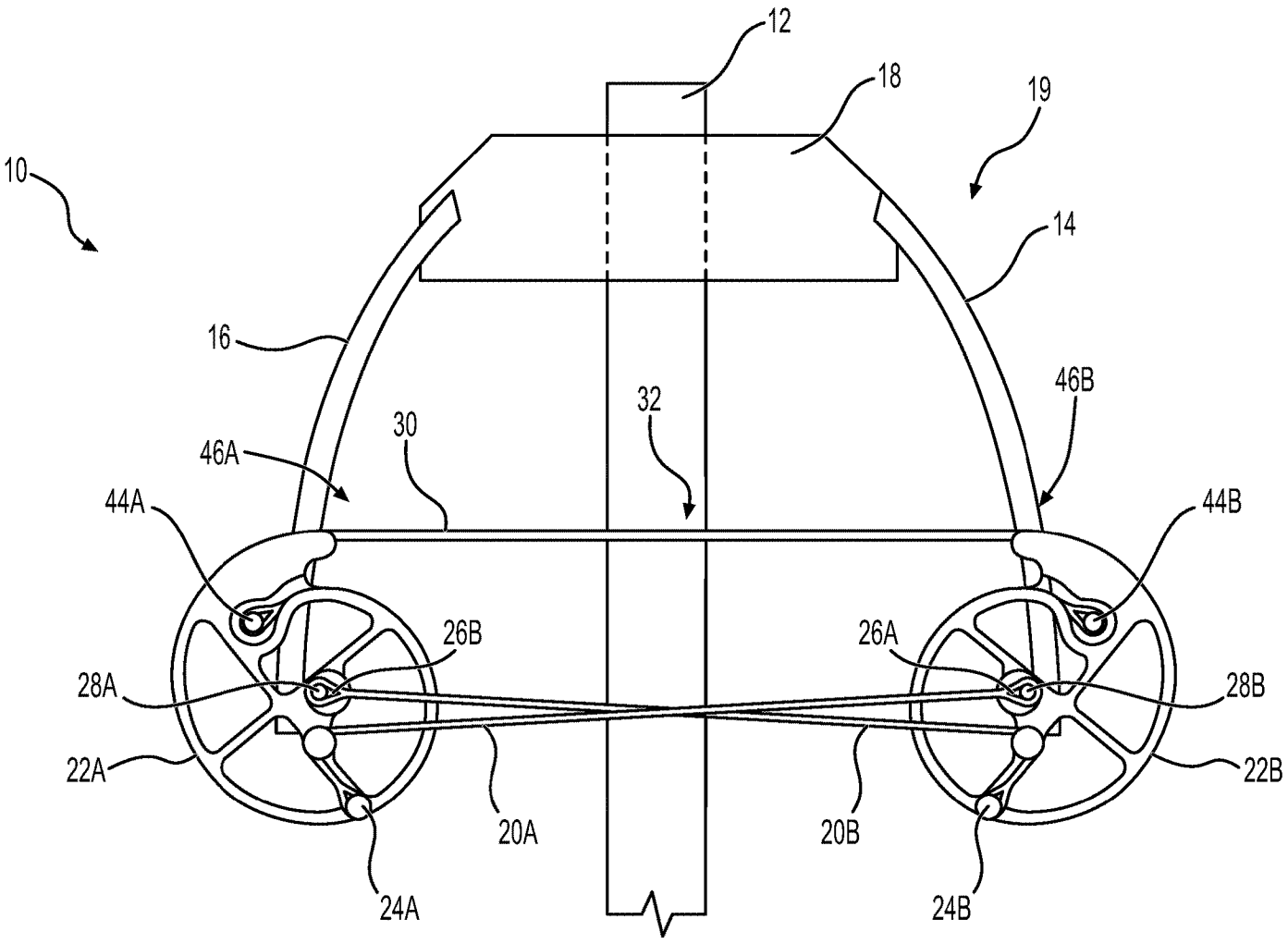
FIG. 1 PRIOR ART
FIG. 1 is a bottom view of a prior art string guide system for a bow in a released configuration.
Figure 2:
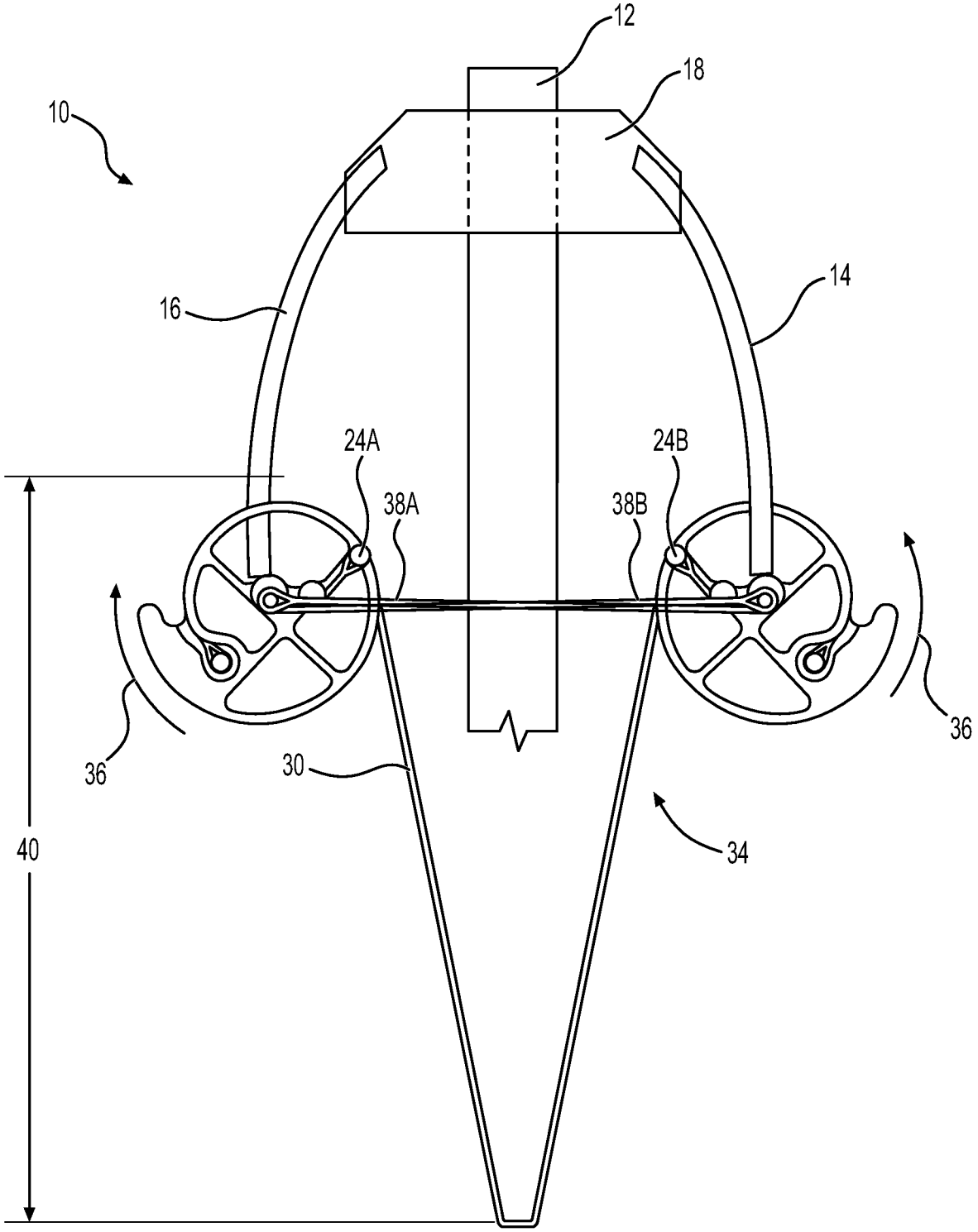
FIG. 2 PRIOR ART
FIG. 2 is a bottom view of the string guide system of FIG. 1 in a drawn configuration.
Figure 3:
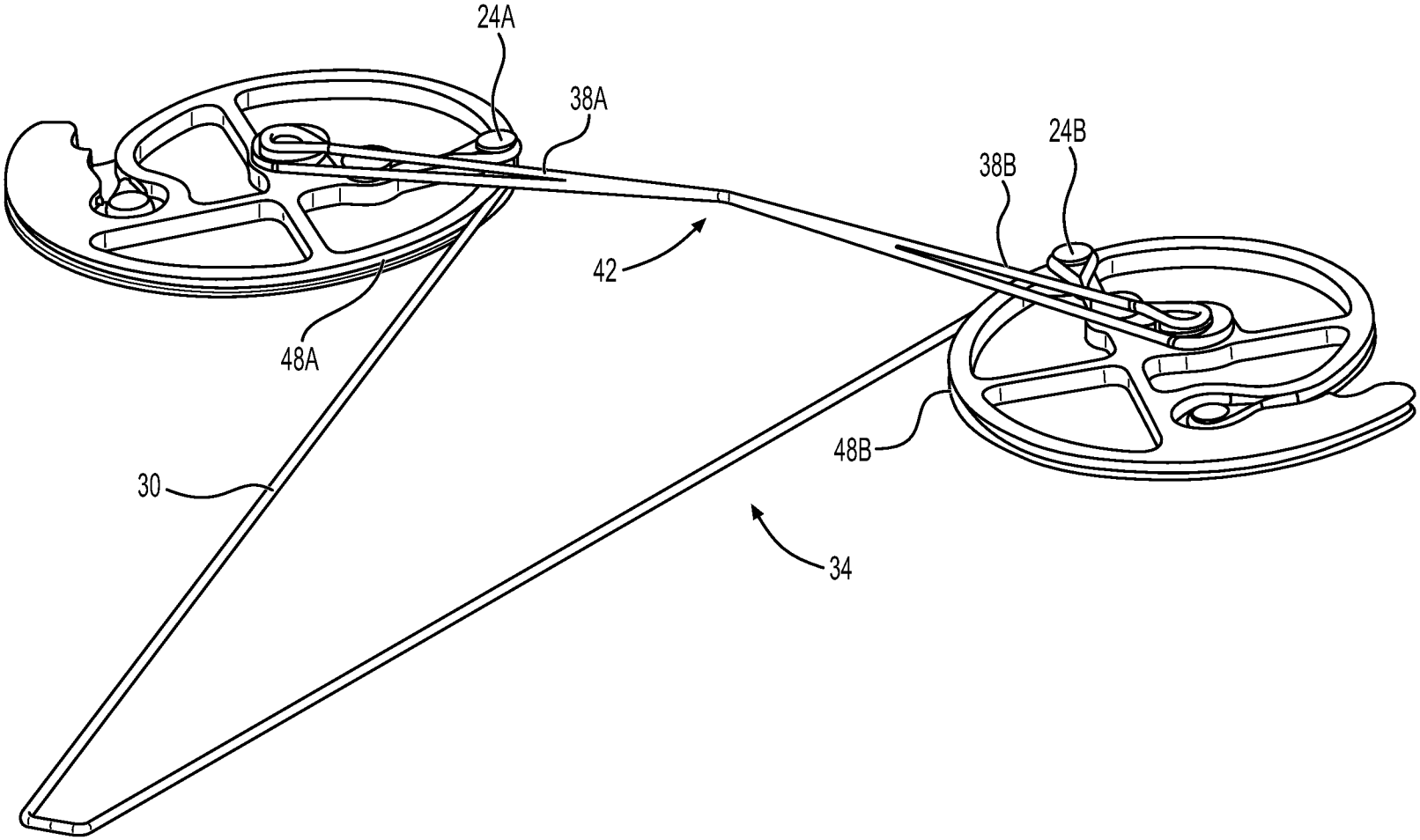
FIG. 3 PRIOR ART
FIG. 3 is a perspective view of the string guide system of FIG. 1 in a drawn configuration and without the limbs, barrel and riser illustrated.
Figure 4:
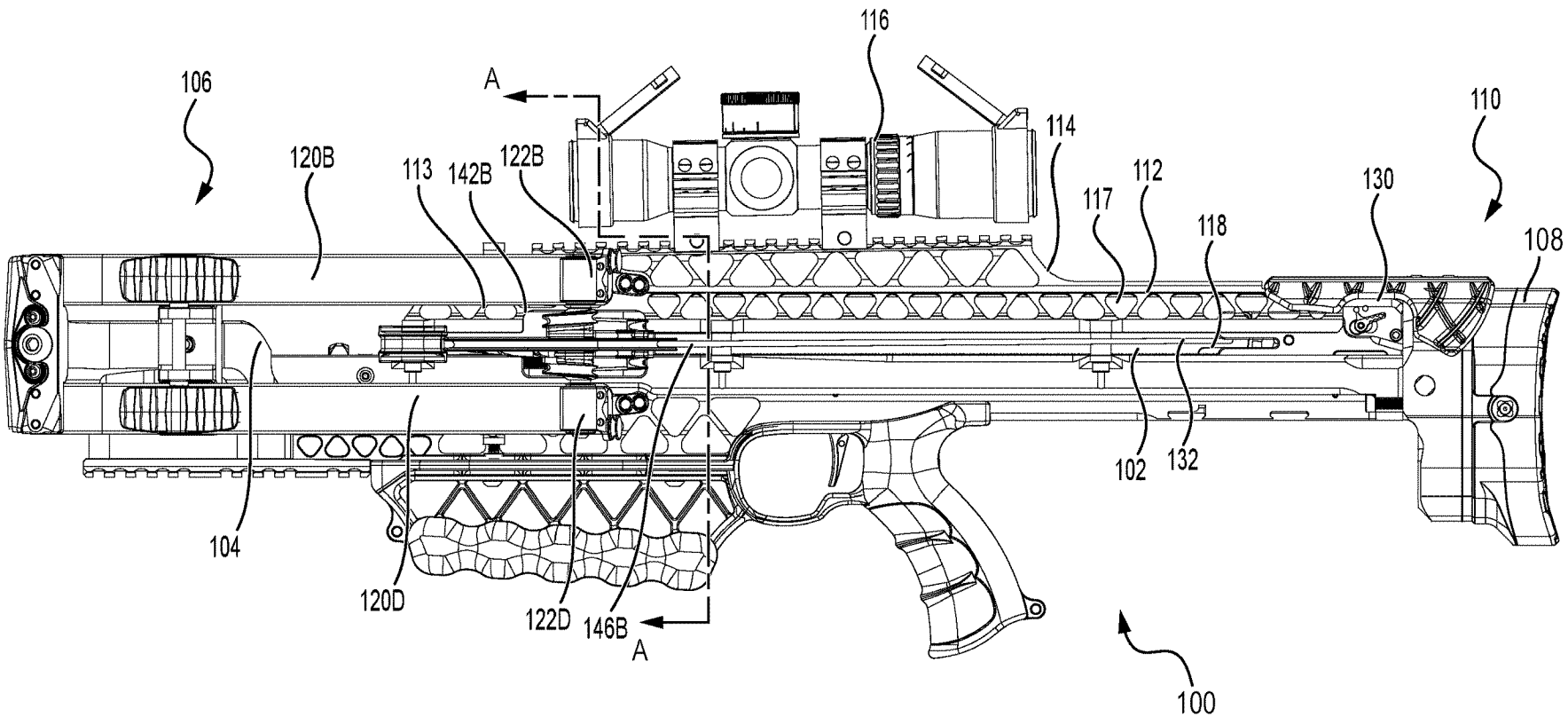
FIG. 4 is a left elevation view of a crossbow in accordance with an embodiment of the present disclosure.
Figure 5:
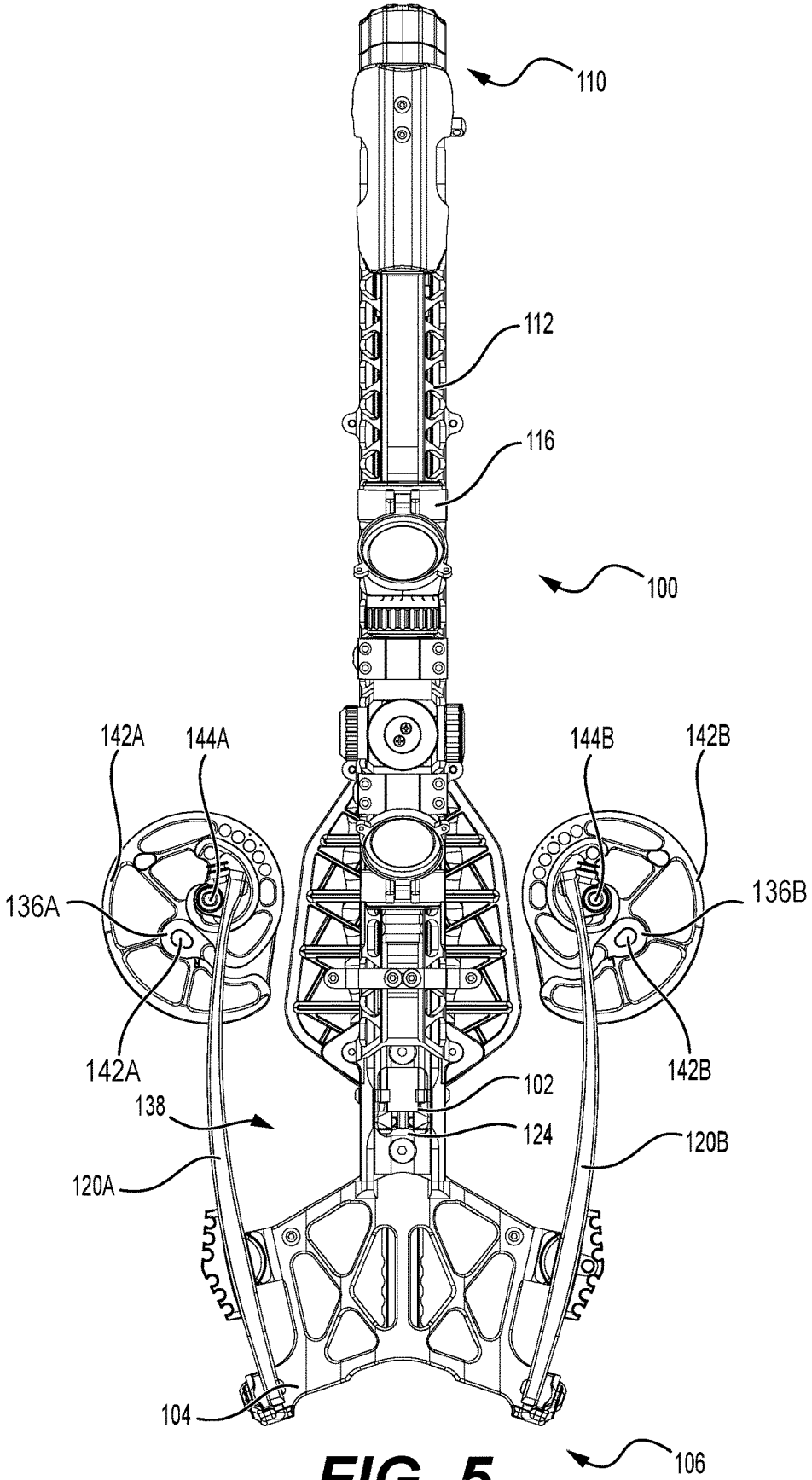
FIG. 5 is a top view of the crossbow of FIG. 4.
Figure 6:
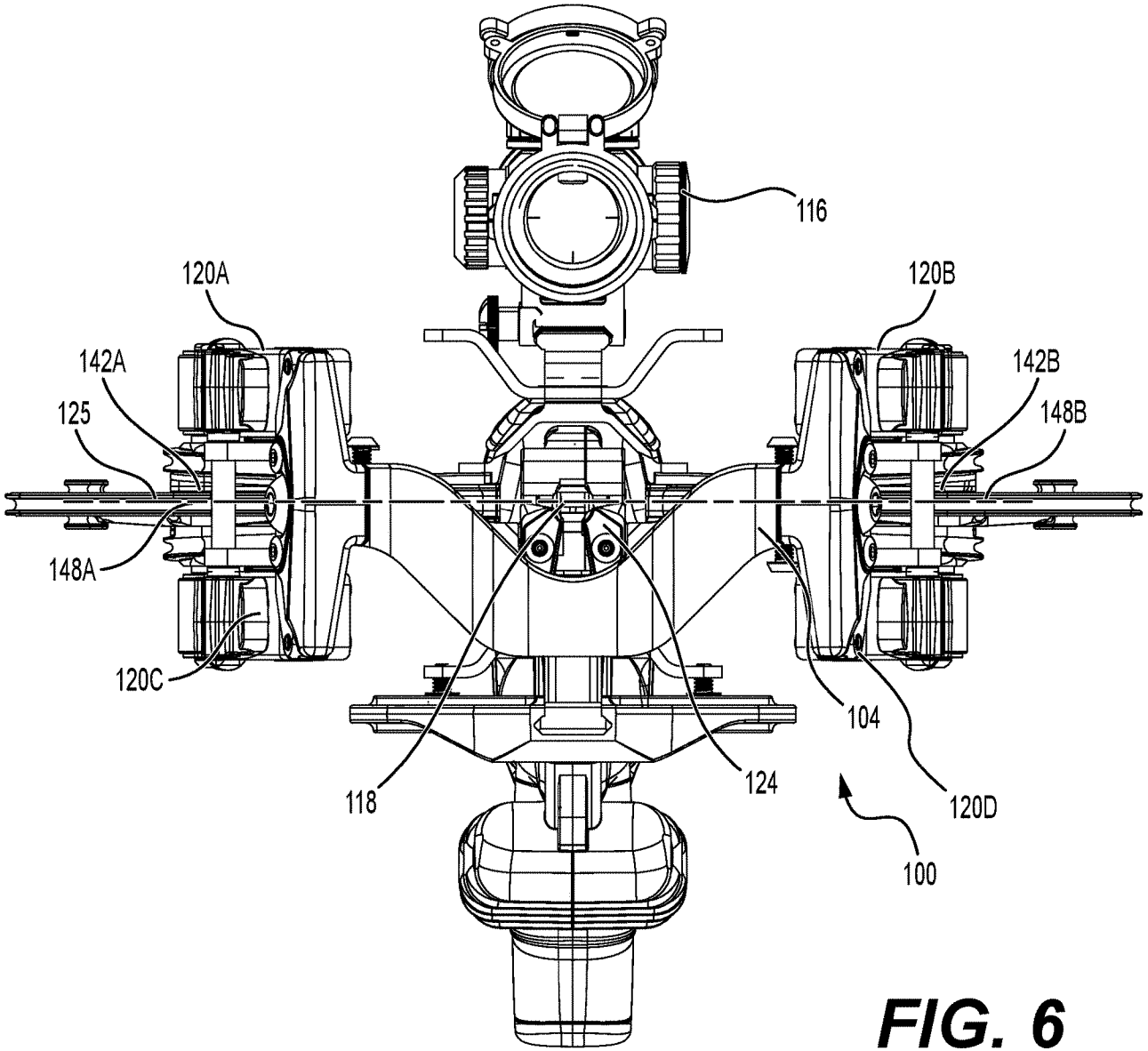
FIG. 6 is a front elevation view of the crossbow of FIG. 4.
Figure 7:
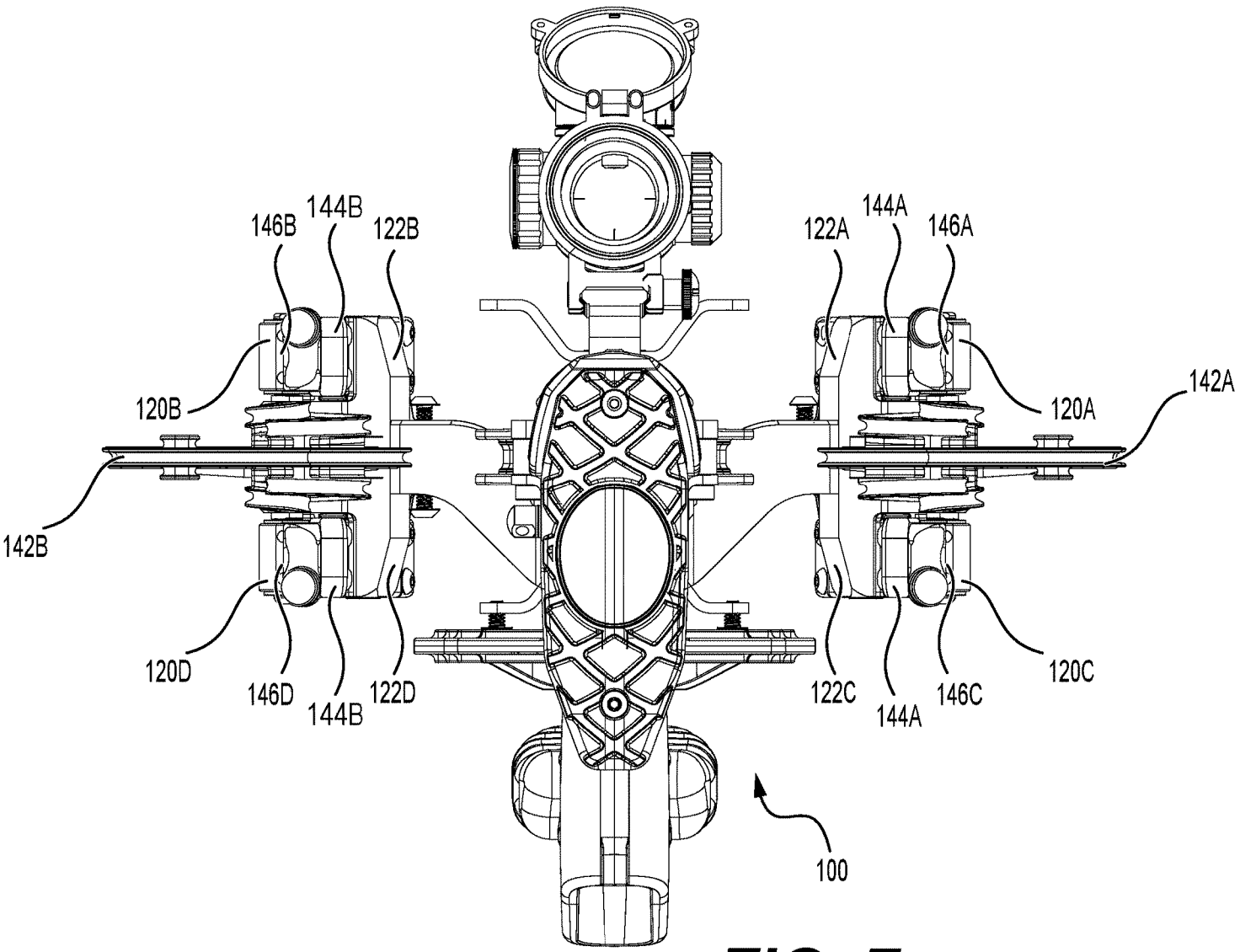
FIG. 7 a rear elevation view of the crossbow of FIG. 4 is a perspective view of the crossbow of FIG. 4 with the safety cover removed.
Figure 8:
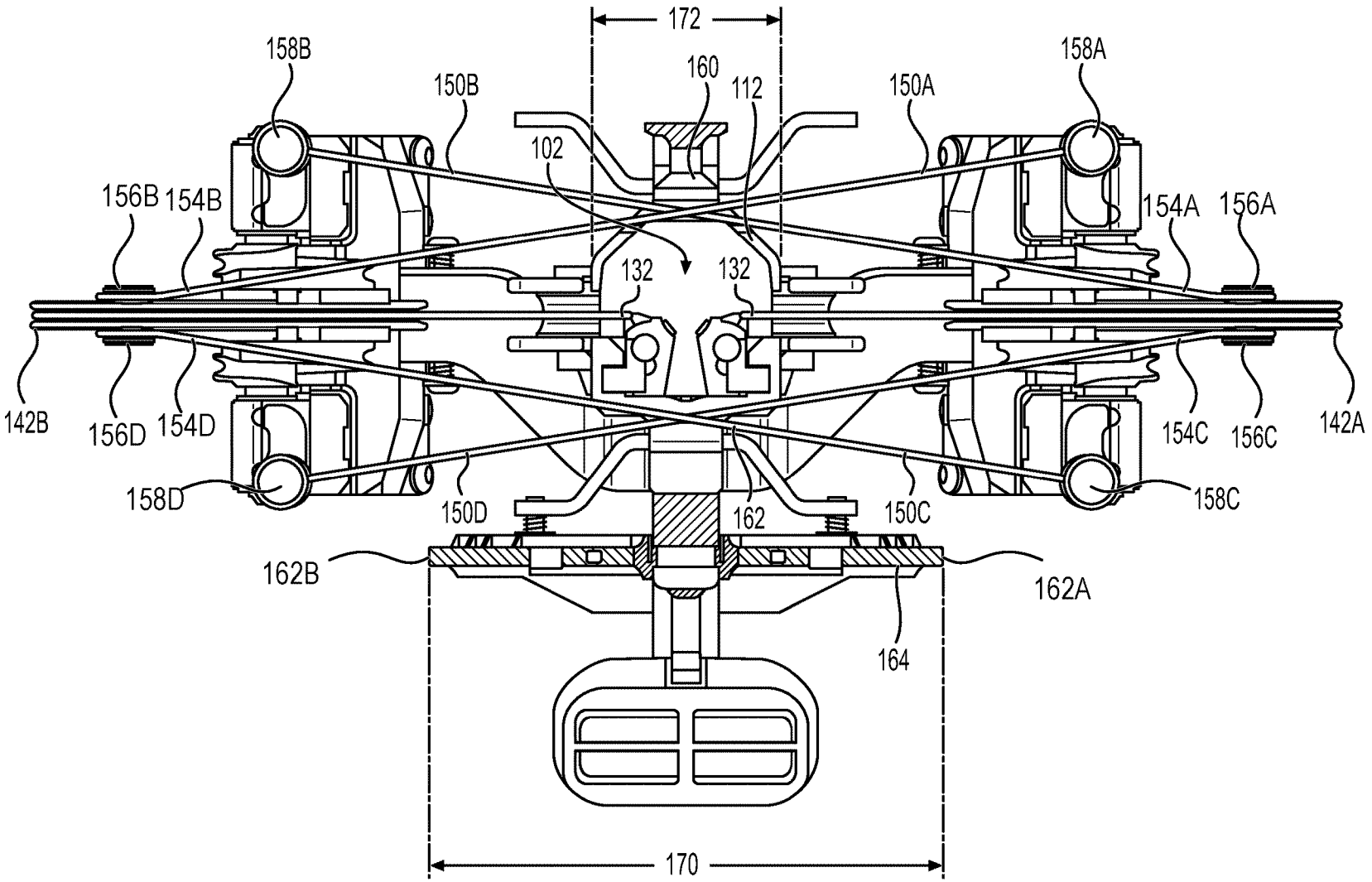

FIG. 8 is a cross sectional view of the crossbow of FIG. 1 taken as shown in FIG. 4.

Figure 9:
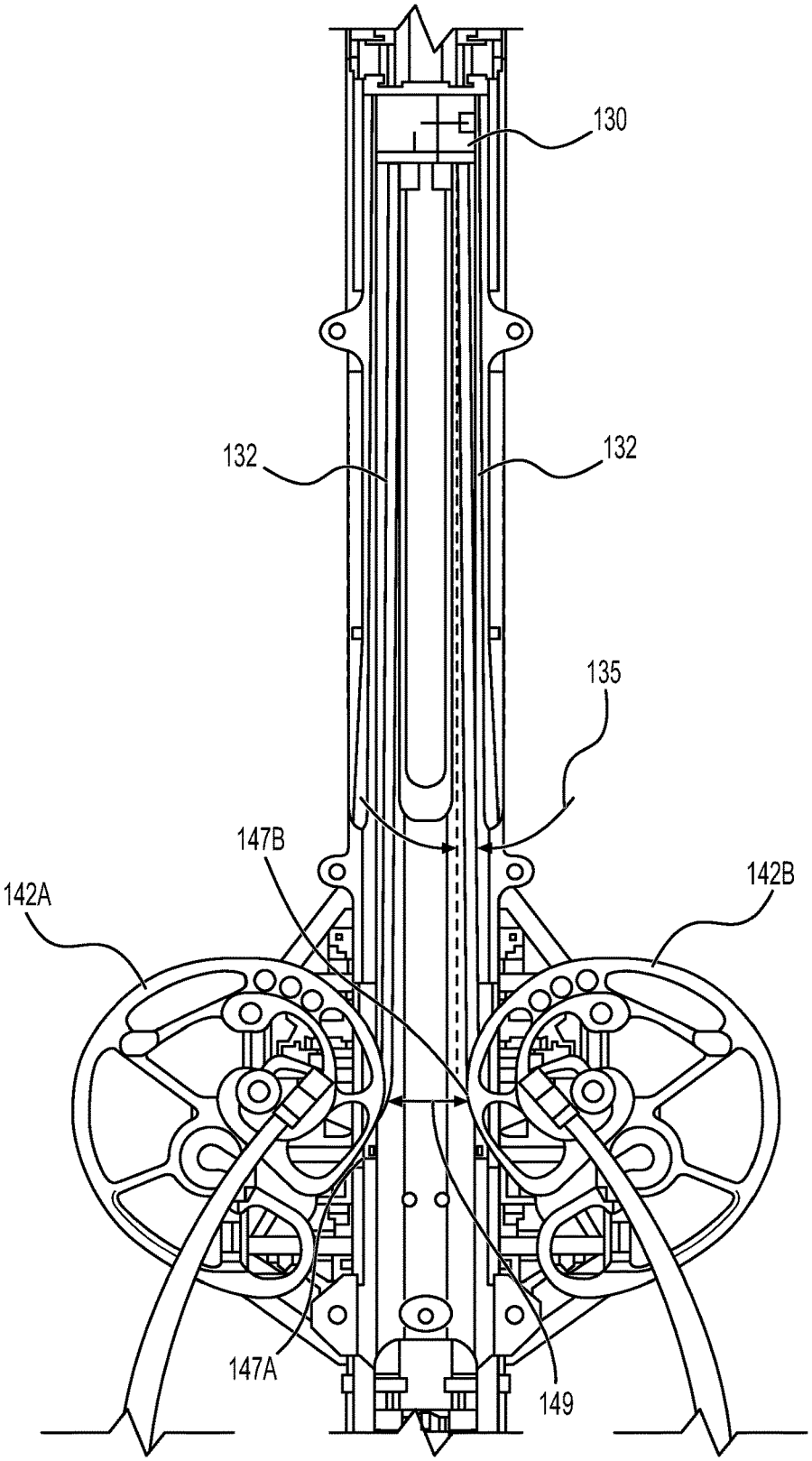

FIG. 9 is a top view of the crossbow of FIG. 4.

Figure 10:
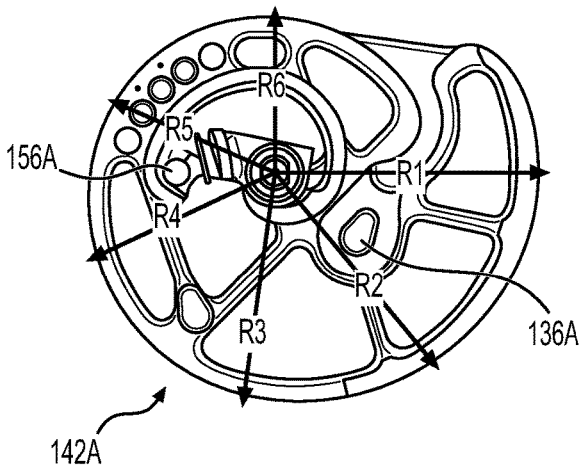

FIG. 10 is a top view of one embodiment of a right side cam.

Figure 11:
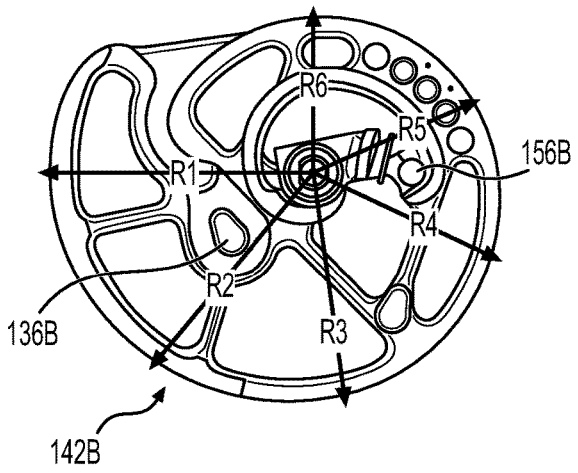
Figure 12:
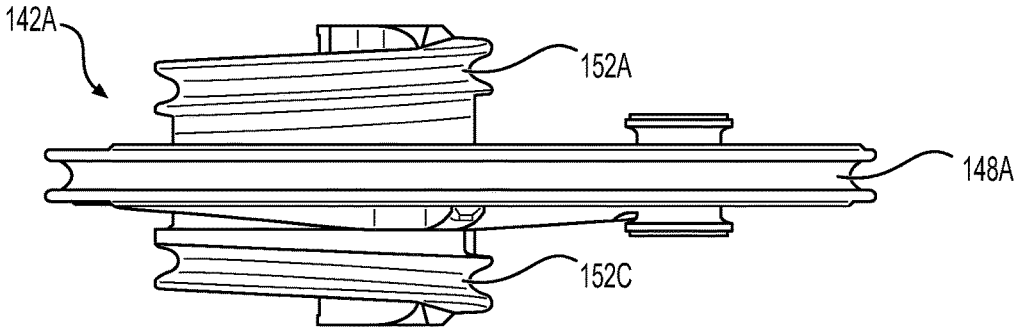

FIG. 11 is a top view of one embodiment of a left side cam;

FIG. 12 is a side elevation view of the embodiment of FIG. 10.

Figure 13:
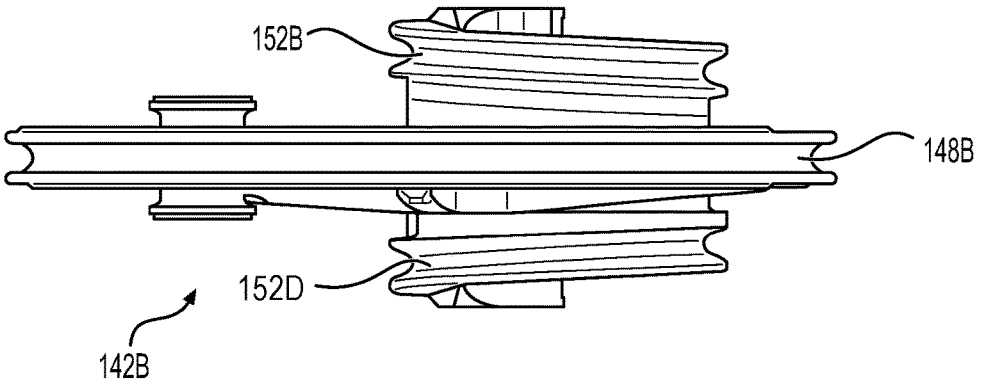

FIG. 13 is a side elevation view of the embodiment of FIG. 12.

Figure 14:
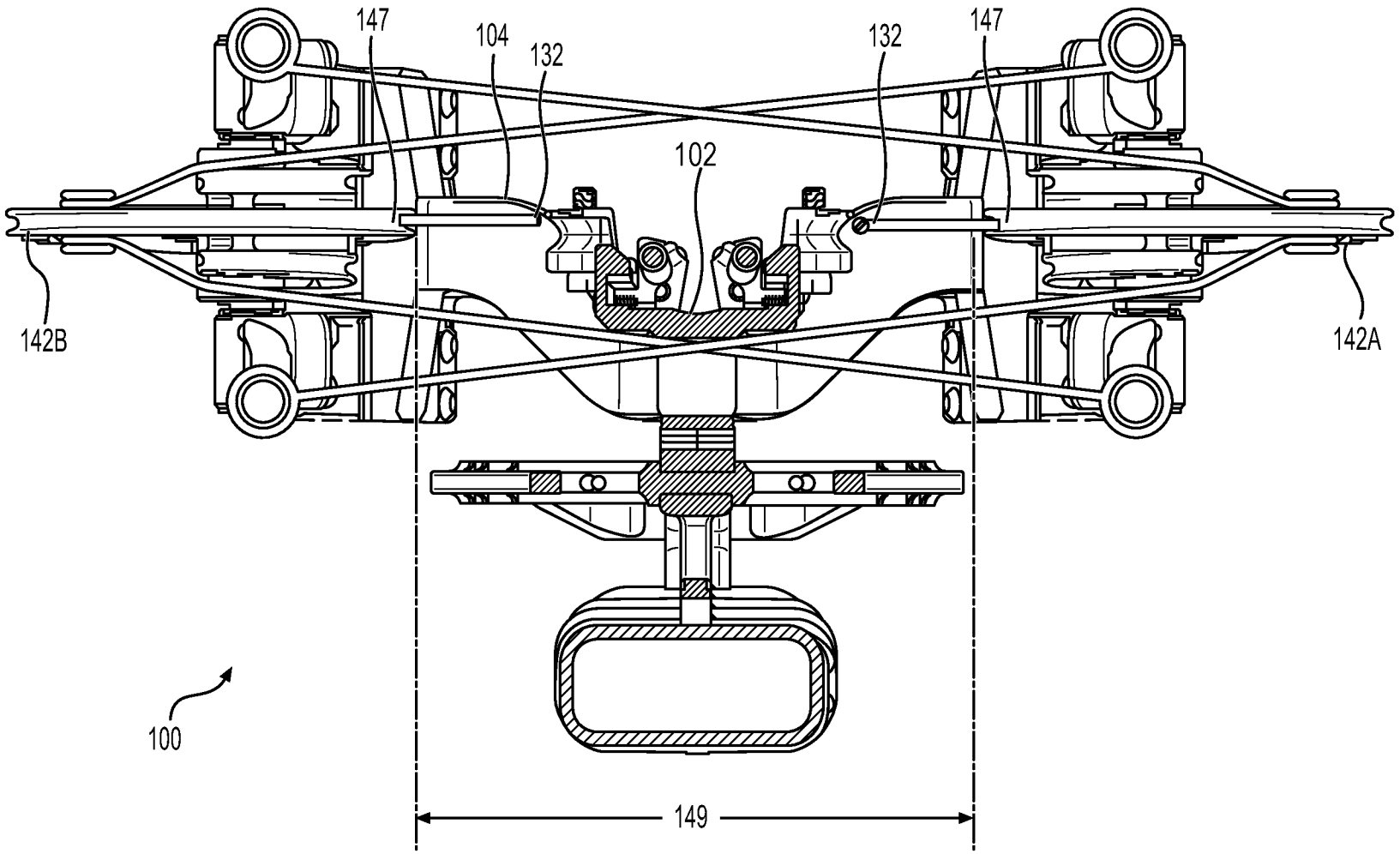

FIG. 14 is a cross sectional view of the crossbow of FIG. 4 after firing.

Figure 15:
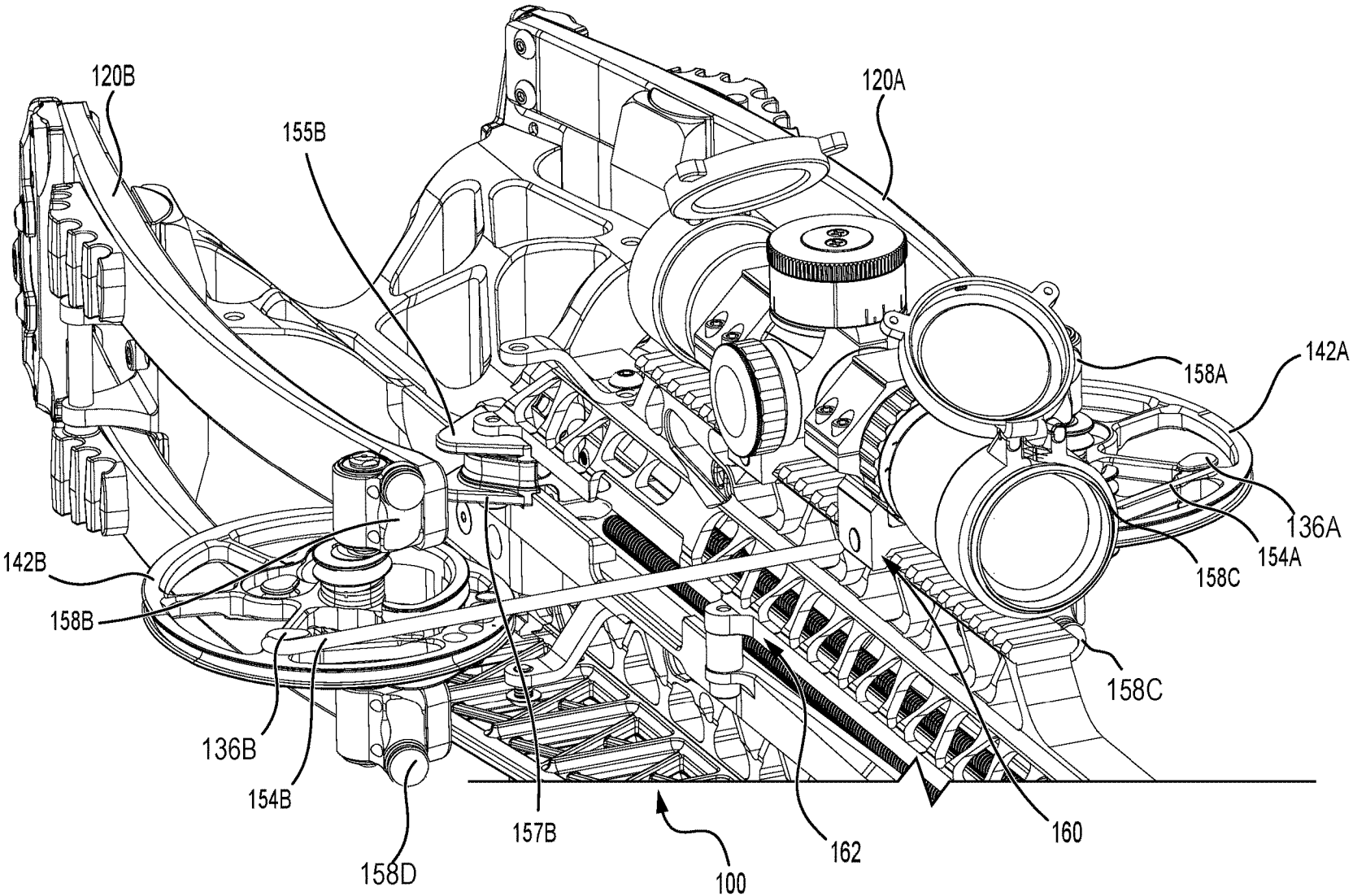

FIG. 15 is a left, top, back view of the crossbow of FIG. 4 after firing.

Figure 16:
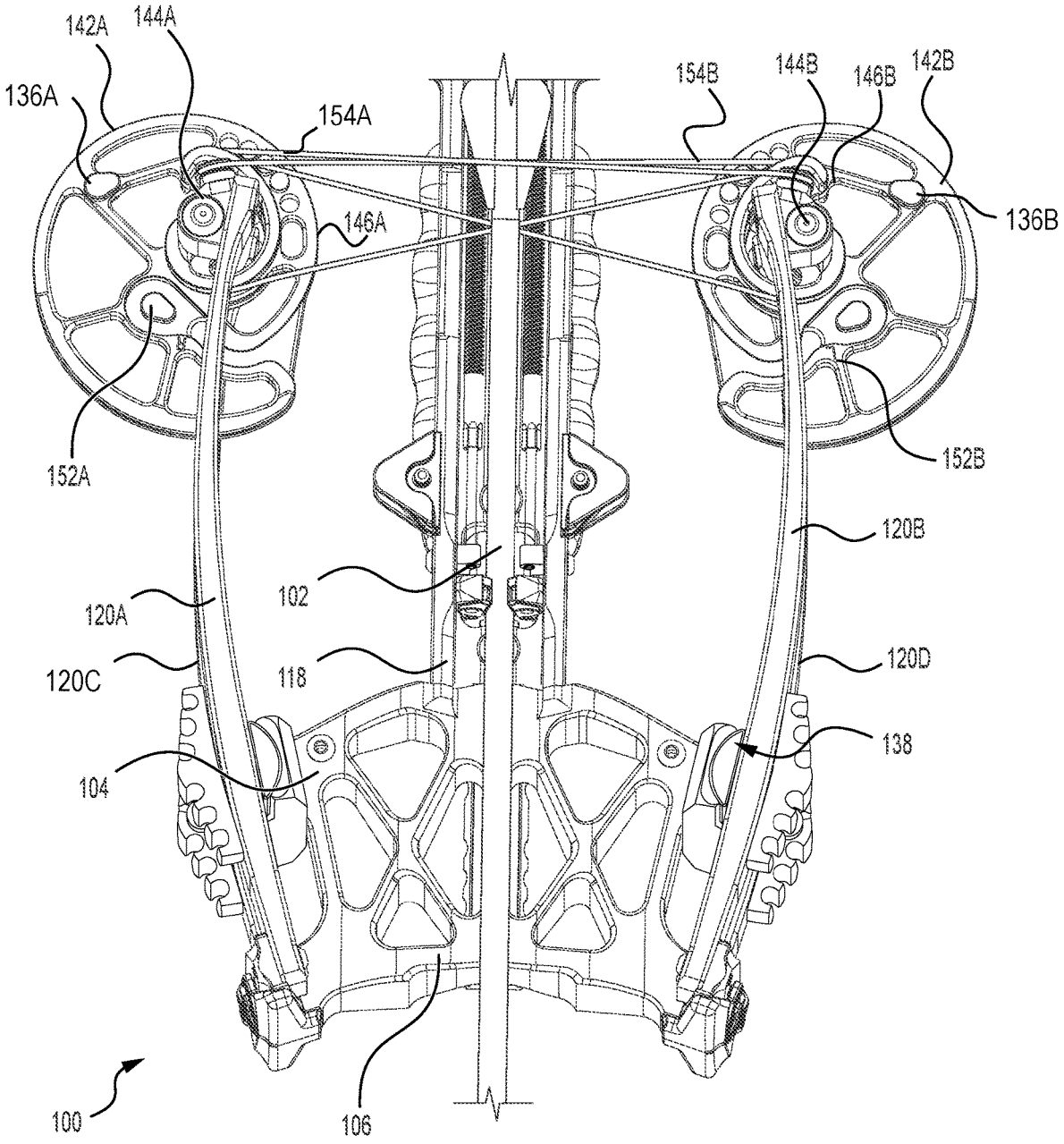

FIG. 16 is a top view of a crossbow of FIG. 4 during cocking.

Figure 17:
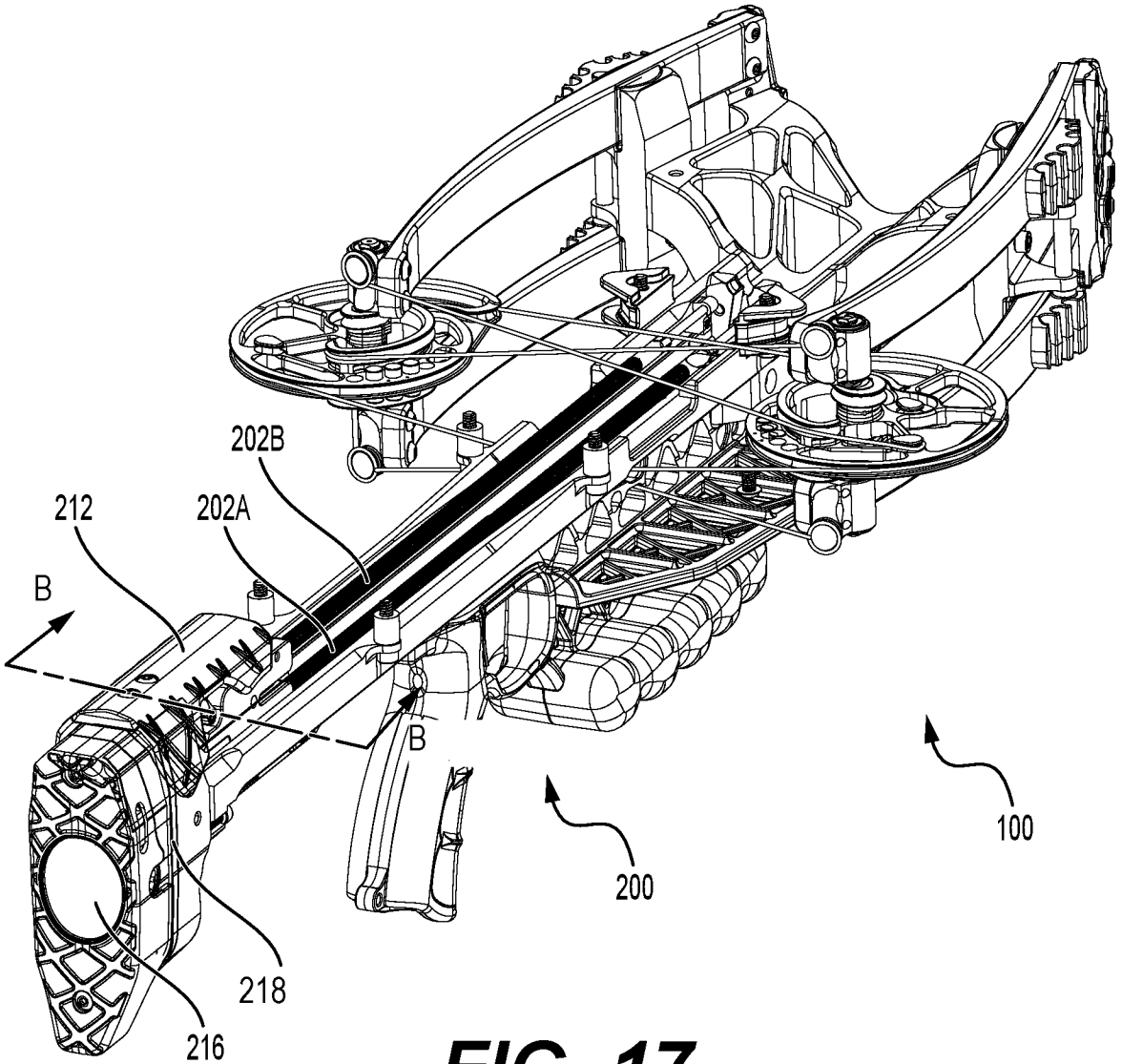

FIG. 17 is a top, right, back perspective view of crossbow of FIG. 4 with certain components removed.

Figure 18:
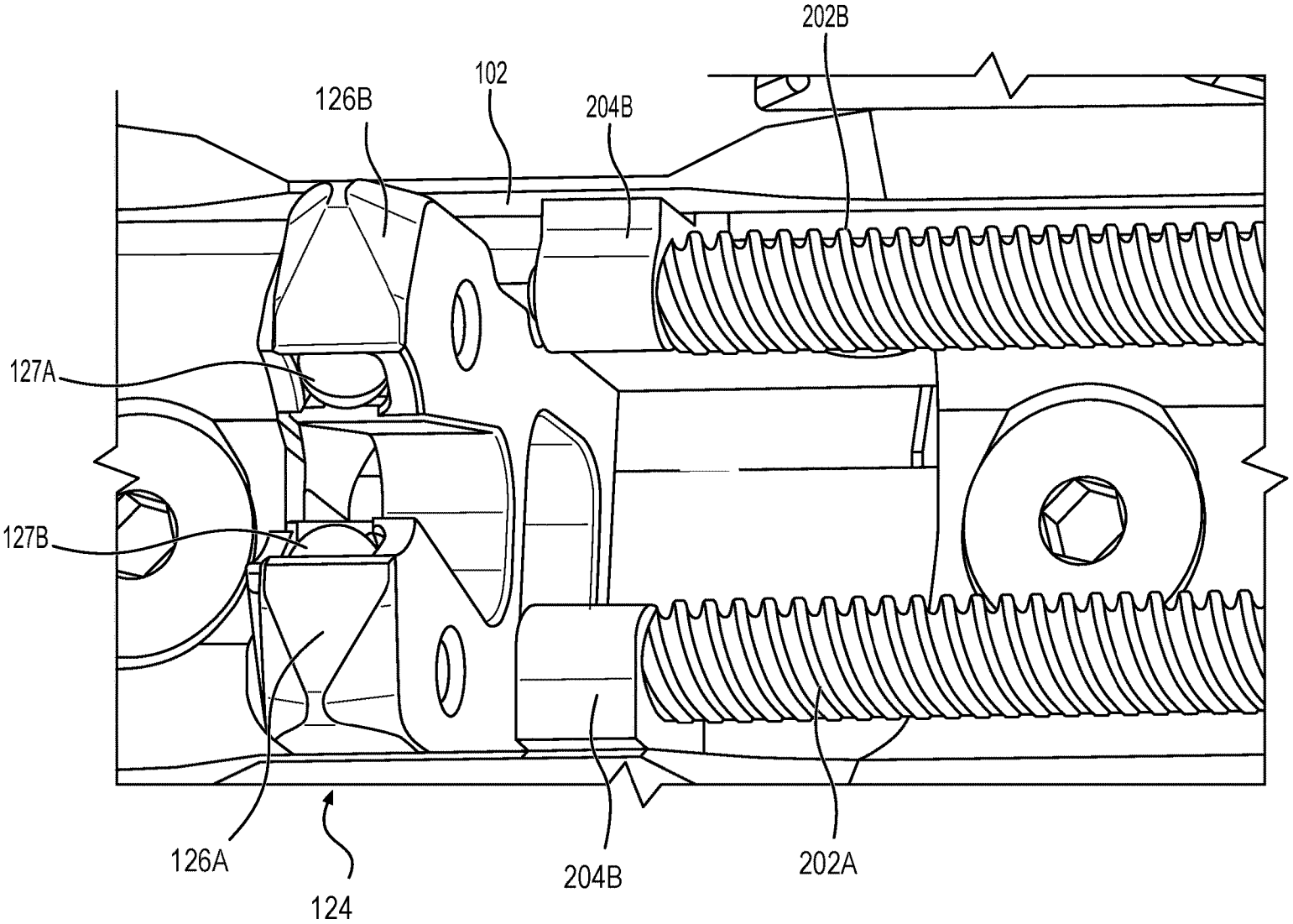

FIG. 18 is a top left back perspective cutaway view of the crossbow of the embodiment of FIG. 4.

Figure 19:
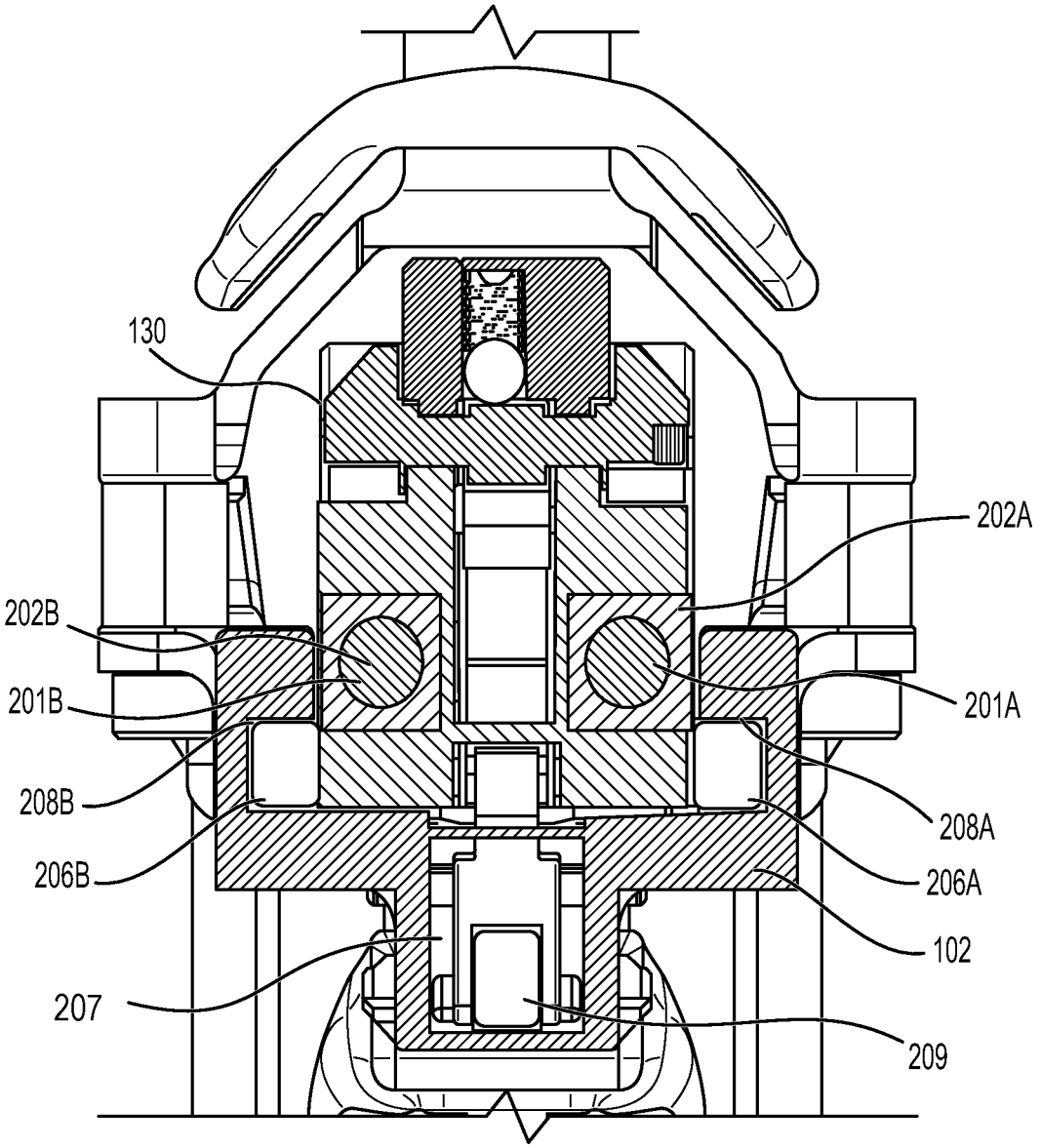

FIG. 19 shows a cross section of crossbow of FIG. 4 taken as shown in FIG. 17.

Figure 20:
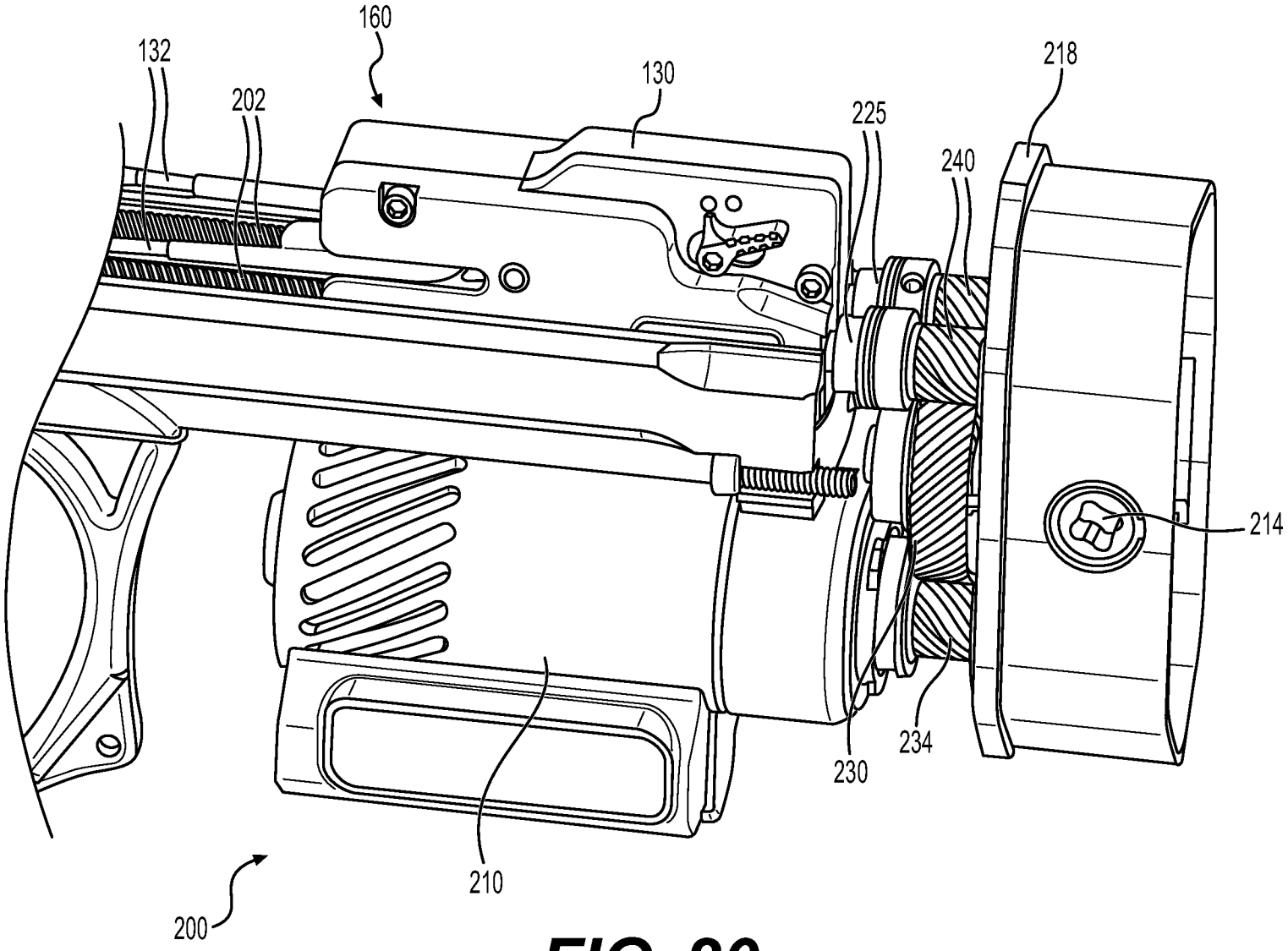

FIG. 20 shows a top, left, back cut away view of a cranking system of the crossbow of FIG. 4.

Figure 21:
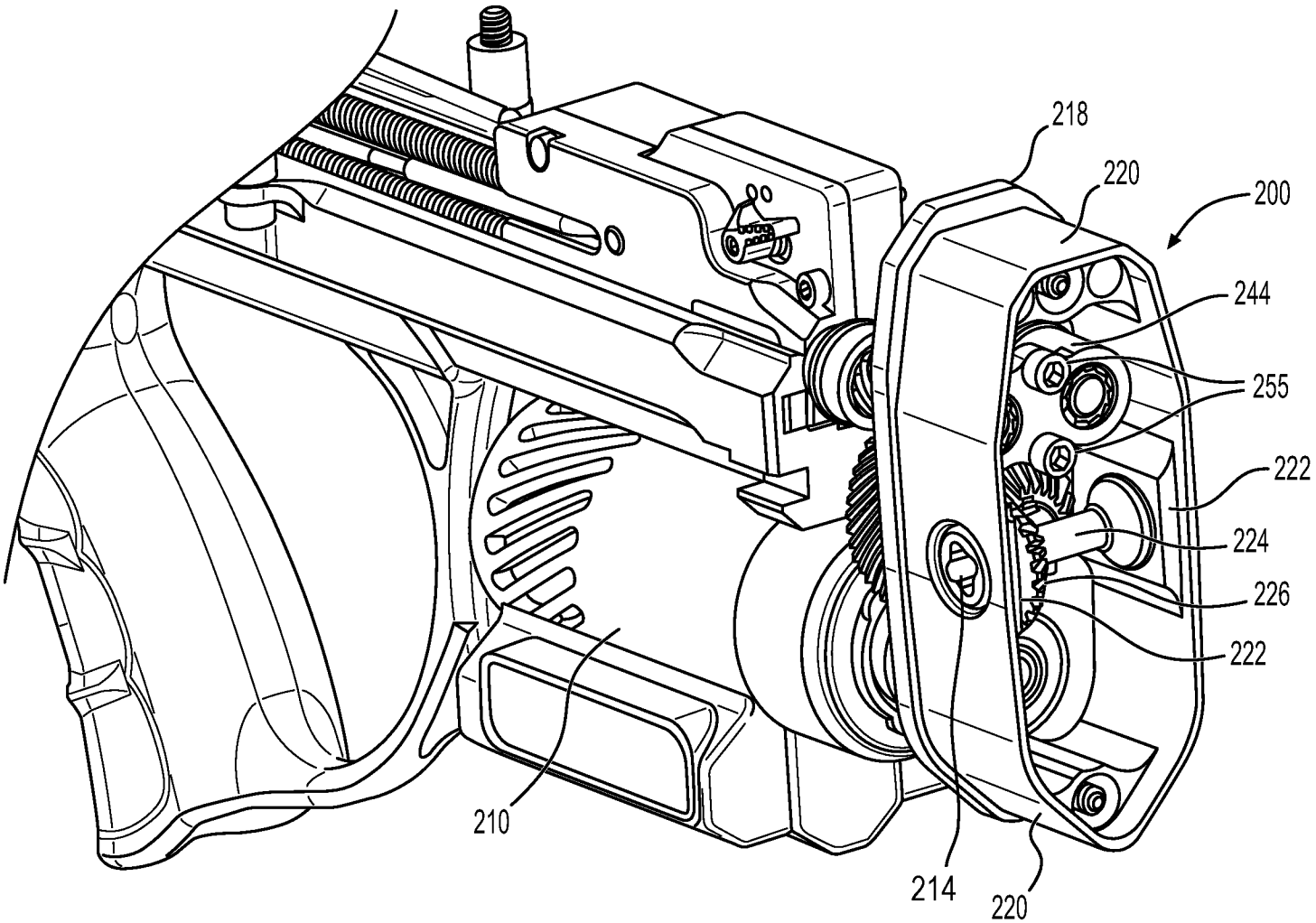

FIG. 21 shows a top, left, back cut away view of a cranking system of the crossbow of FIG. 4.

Figure 22:
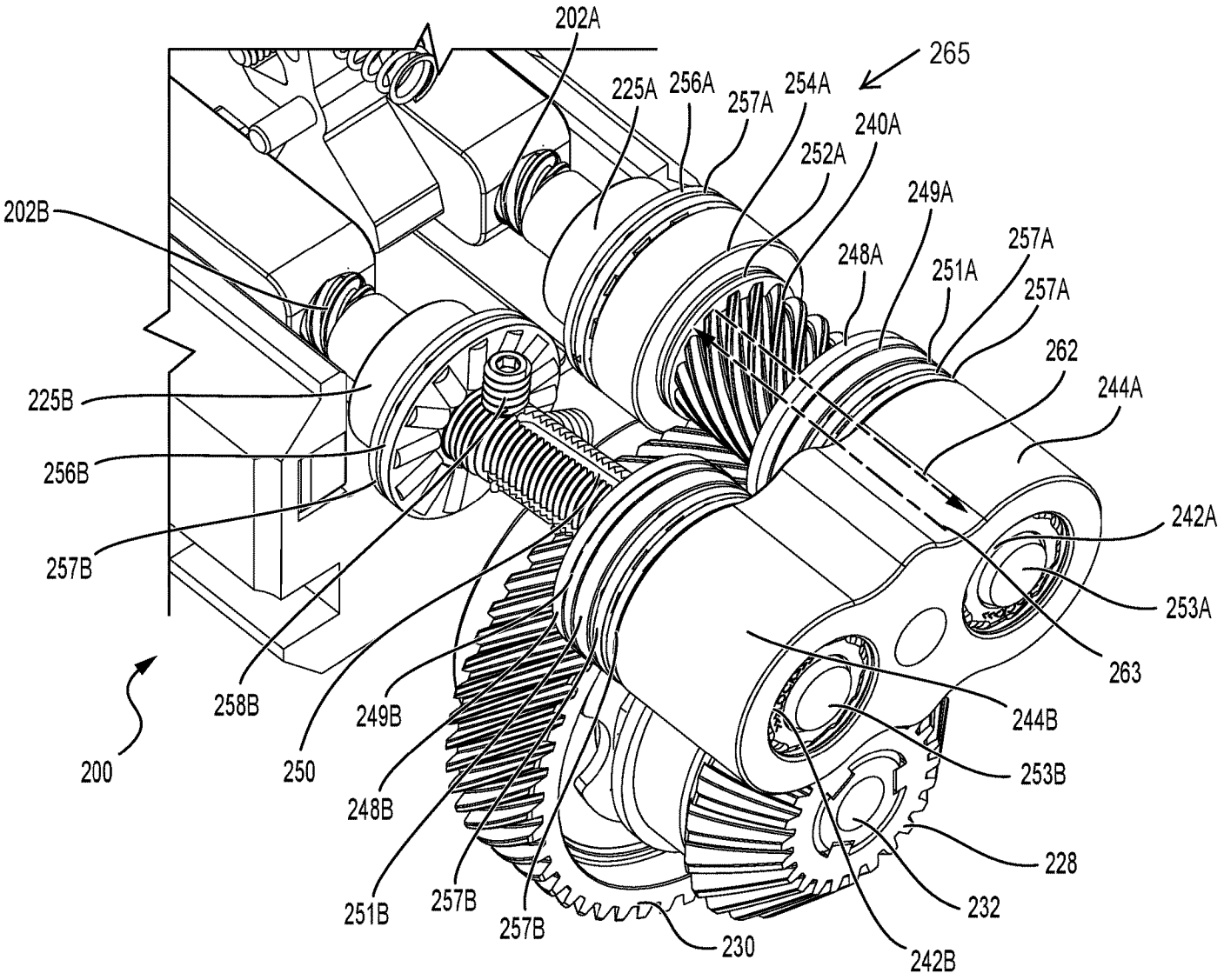

FIG. 22 shows a top, left, back cut away view of a cranking system of the crossbow of FIG. 4.

Figure 23:
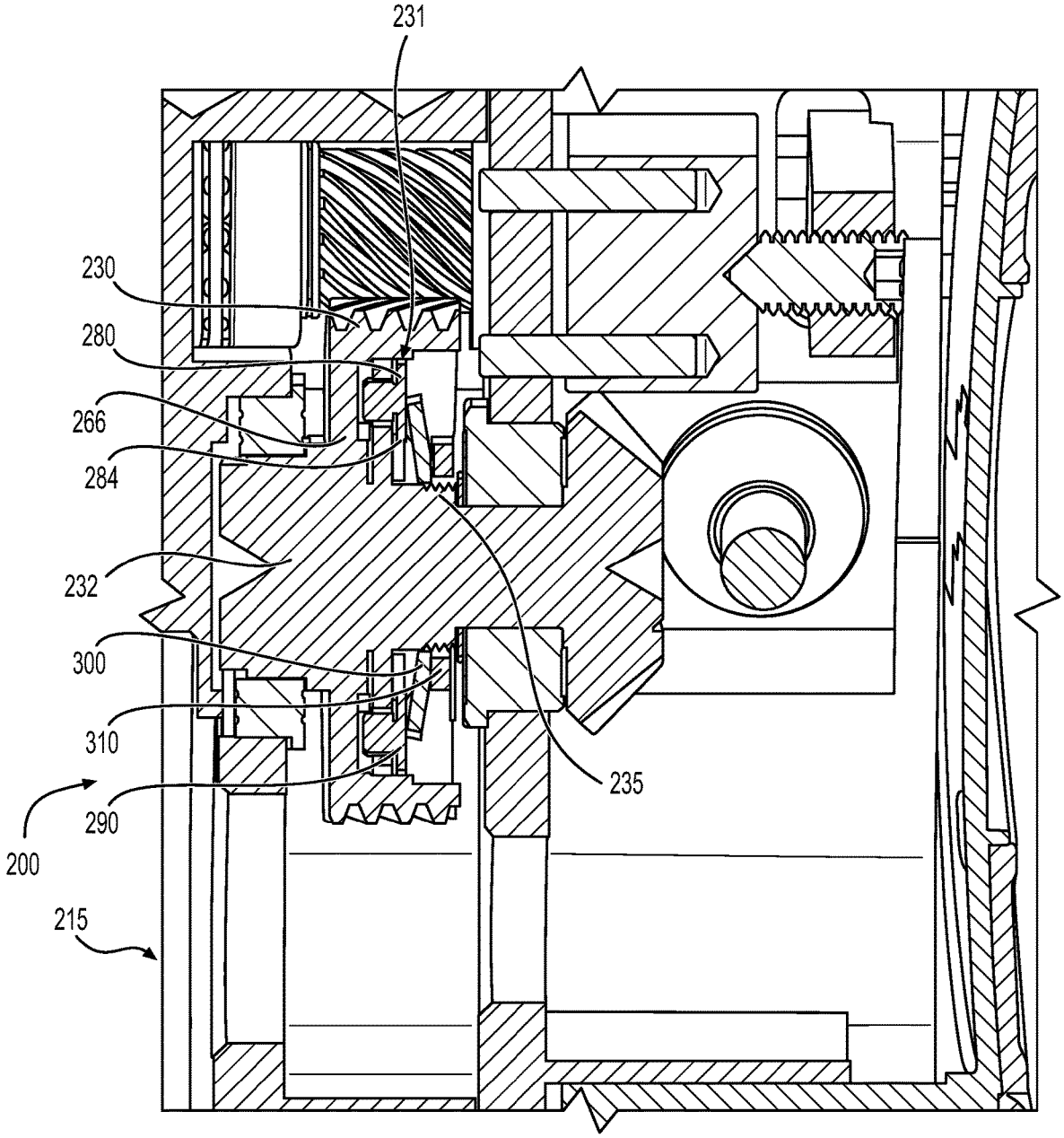

FIG. 23 shows a partial left side cross-section view of cranking system having a spiral gear clutch.

Figure 24:
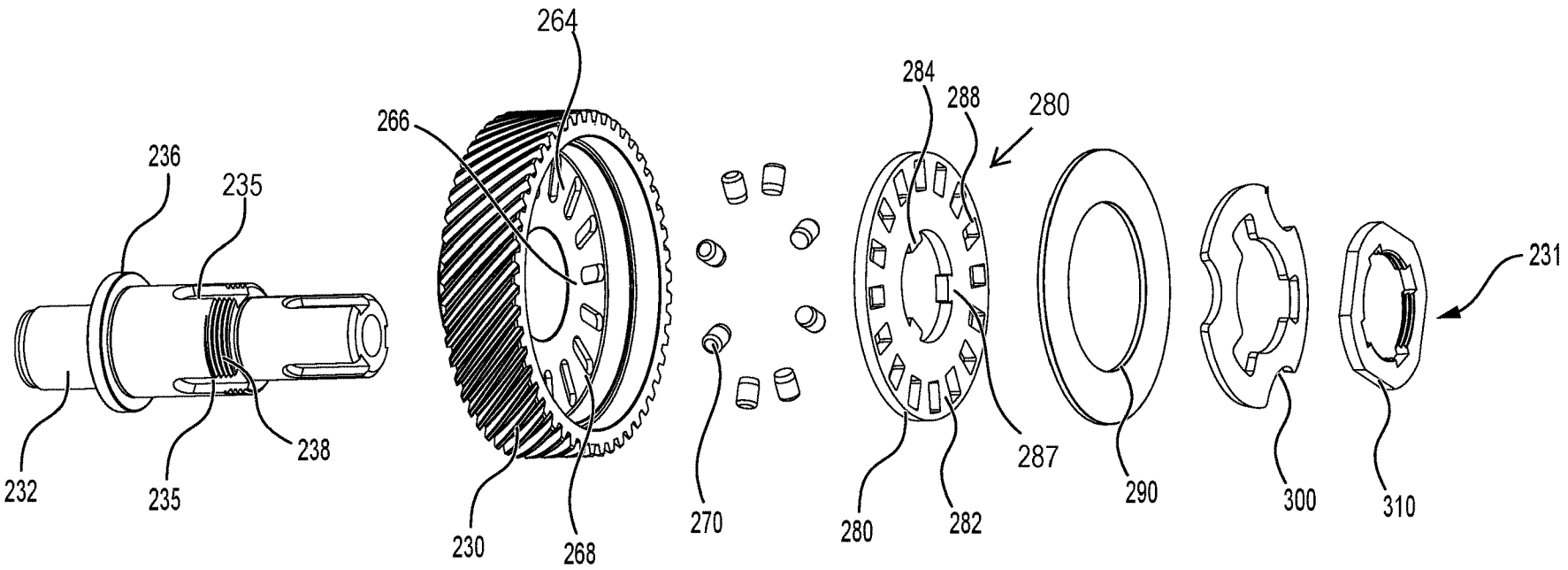

FIG. 24 shows a left back perspective assembly view of a spiral gear clutch.

DETAILED DESCRIPTION OF THE INVENTION

FIGS. 4-7 illustrate crossbow 100 as being in a fully cocked position. As is shown in FIGS. 4-7, in this embodiment, crossbow 100 includes a center rail 102 with a riser 104 mounted at the distal end 106 and a stock 108 located at the proximal end 110. An arrow 118 is suspended above the center rail 102 by string carrier 130 that is located near the proximal end 110 and by a tunable arrow rest 124 near the proximal end 110 when crossbow 100 is in the cocked position. Arrow rest 124 positions first journal surfaces 127A and 127B to help to position an arrow 118 so that arrow 118 can be thrust along and substantially leaves crossbow 100 traveling along a firing plane 125.

Center rail 102 and the riser 104 comprise a frame 138. The frame 138 may be a unitary structure, such as, for example, a molded carbon fiber component or separate components. The frame 138 includes a string cover 112. The string cover 112 extends over the center rail 102 permitting movement of the string carrier 130 and a draw string 132 in a space laterally bounded by center rail 102 and string cover 112. String cover 112 is preferably at least partially transparent to assist the user in loading and unloading an arrow, and to monitor activities of the draw string 132 and the string carrier 130. In the illustrated embodiment, the string cover 112 includes cut-outs 117. In another embodiment, some or all of the string cover 112 may be constructed from a transparent material. Cut-outs 117 are preferably configured so that a user is unable to place fingers in the draw string path.

Scope mount 114 with a tactical, picatinny, or weaver mounting rail is attached to, or integrally formed with, the string cover 112. Scope 116 preferably includes a reticle with gradations corresponding to the ballistic drop of arrows 118 of a particular weight. The terms "bolt" and "arrow" are both used for the projectiles launch by crossbows and are used interchangeable herein. Various arrows and nocks are disclosed in commonly assigned U.S. patent Ser. No. 15/673,784 entitled Arrow Assembly for a Crossbow and Methods of Using Same, filed Aug. 10, 2017, which is hereby incorporated by reference.

Riser 104 joins one end of each of right side upper limb 120A, right side lower limb 120C, left side upper limb 120B and left side lower limb 120D ("120") to center rail 102. In the illustrated embodiment, limbs 120 have a generally concave shape directed toward a center axis Y of the center rail 102 and extend from the riser toward the proximal end 110, ending at free ends 122A, 122B, 122C, and 122D. Limbs 120 are formed from an elastically deformable material shaped to resiliently flex during cocking. Potential energy is stored in limbs 120 as they flex. The material used to form limbs 120, the construction of limbs 120 and the shape of limbs 120 are selected to allow the potential energy stored in limbs 120 to be rapidly released during firing. Pivot mounts 146A, 146B, 146C and 146D are located proximate free ends 122A, 122B, 122C, and 122D and limbs 120A, 120B, 120C, and 120D are designed to accept such a mounting.

A right side pivot pin 144A is mounted at an upper end to an upper right side pivot mount 146A and at lower end to a lower right side pivot mount 146C and extends across a gap between right side upper limb 120A and right side lower limb 120C. Right side cam 142A is mounted to right side pivot pin 144A for rotation in the gap between the right side upper limb 120A and lower right side limb 120C. Collectively, right side pivot pin 144A, upper right side pivot mount 146A and lower right side pivot mount 146C comprise a right side cam module. Similarly, left side pivot pin 144B is mounted at an upper end to an upper left side pivot mount 146B and at lower end to a lower left side pivot mount 146D and extends across a gap between the left side upper limb 120B and right side lower limb 120D. Left side cam 142B is mounted to left side pivot pin 144B for rotation in the gap between the left side upper limb 120B and right side lower limb 120D. Collectively, left side pivot pin 144B, upper left side pivot mount 146B and lower left side pivot mount 146B comprise a left side cam module.

The operation of this embodiment of crossbow 100 will now be described in greater detail with reference to FIG. 8 which shows a rear cross section of crossbow 100 taken as illustrated in FIG. 4, in FIG. 9 which shows a top view of crossbow 100 with various features removed to more clearly show the orientation of draw string 132 when crossbow 100 is cocked, FIG. 10 is a top view of one embodiment of right side cam 142A, FIG. 11 which shows a top view of left side cam 142B, FIG. 12 is a side elevation of right side cam 142A, and FIG. 13 shows a side elevation of left side cam 142B.

As is shown in FIGS. 8-13, cams 142A and 142B have draw string journals 148A and 148B each terminating in a draw string attachment point 136A and 136B respectively. The draw string journals 148A and 148B may be aligned with the firing plane 125 (e.g., co-planar). Draw string 132 has one end mounted to attachment point 136A and another end mounted to attachment point 136B. Cams 142A and 142B are sized and shaped to permit controlled winding of a predetermined length of draw string 132 and controlled unwinding of the predetermined length of draw string 132 from cams 142A and 142B as cams 142A and 142B are rotated during cocking, firing or during other types of decocking. The predetermined length of draw string 132 that can be wound up or released from cams 142A and 142B determines in part a power stroke of crossbow 100 which in turn determines a distance of travel of arrow 118 along which draw string 132 can apply force against arrow 118 to increase the speed and kinetic energy that arrow 118 will have when arrow 118 leaves crossbow 100. Longer power strokes may enable more energy to be transferred to an arrow during firing.

It is also important that cams 142A and 142B operate at a substantially similar rate of speed in drawing in the lengths of draw string 132 during firing. Inconsistencies can influence the path of travel of arrow 118 and induce inefficiencies lowering the overall efficiency of energy transfer from limbs 120 to arrow 118.

Cams 142A and 142B each have upper string guides 152A and 152B and lower string guides, 152C and 152D. String guides 152A, 152B, 152C and 152D each have a mounting point 156A, 156B, 156C, 156D at which a first end 154A, 154B, 154C, 154D of a power cable 150A, 150B, 150C and 150D can be mounted and provide a path about which a predetermined length of power cables 150A, 150B, 150C and 150D can wrap about right side cam 142A or left side cam 142B respectively. In the embodiment illustrated, upper power cables 150A, 150B extend across frame 138 and are attached to limb mountings 158B and 158A respectively. Similarly, lower power cables 150C, 150D extend across frame 138 and are attached to limb mountings 158D and 158C respectively.

String guides 152A, 152B, 152C and 152D are configured to draw a predetermined length of power cables 150A, 150B, 150C and 150D onto string guides 152A, 152B, 152C and 152D when string carrier 130 operates to pull draw string 132 to the cocked position. This has the effect of drawing limb ends 122 inwardly against the resilient bias of limbs 120 and stores potential energy in limbs 120.

It will be observed from FIG. 8, that upper string guides 152A and 152B are configured so that power cables 150A and 150B cross center rail 102 along an upper path 160 that is apart from center rail 102. Similarly, lower string guides 152C and 152D are configured so power cables 150C and 150D cross center rail 102 along a lower path 162 that is also apart from center rail 102. Here upper path 160 passes through scope mount 114 while lower path passes through a portion of crossbow 100 between center rail 102 and a forward grip surface. This provides a separation between upper path 160 and lower path 162 that enables power cables 150A, 150B, 150C and 150D to cross over center rail 102 without interfering with the movement of string carrier 130, or arrow 118 within the space provided between center rail 102 and string cover 112. This approach, in turn enables crossbow 100 to be more compact while still retaining desired functionality including helping to ensure that a balanced application of force is made.

Additionally, in this embodiment, by running power cables 150 directly from the string guides 152 to limb mountings 158 the predetermined length of power cables 150 that are available for winding on the upper and lower string guides 152 can be greater and by using a spiral or helical winding of the cable about the string guides 152 it becomes possible to store a greater length of power cables 150 on each of the string guides 152 and to do so with greater radius of winding to reduce the stresses experienced by the power cables 150.

In FIGS. 4-9, crossbow 100 is shown in a drawn configuration, with substantially a full portion of the predetermined length of draw string 132 paid out from cams 142A and 142B such that draw string 132 extends to string carrier 130. It will be observed that right side cam 142A and left side cam 142B extend into a lateral space bordered on the outside by an outer lateral zone 170 defined by lateral edges 162A and 162B of finger guard 164 and also extending into an inner lateral zone 172 defined by lateral edges string cover 112 creating a cam gap 149 therebetween that extends for a distance of between about 20 mm and 60 mm and that draw string 132 extends therefrom from tangent points 147A and 147B toward string carrier 130.

As can be seen from this, when crossbow 100 is configured to fire an arrow, draw string 132 is contained within the lateral boundaries provided by center rail 102 and string cover 112. Distal end 113 of the string cover 112 is sized to accommodate a cam gap 149 at a high end of the range between the tangent points 147, so that the draw string 132 may be contained within string cover 112. In this embodiment, string carrier 130 captures a segment of the draw string 132 that is smaller than cam gap 149, and this causes draw string 132 to form a V-shaped configuration in the drawn configuration with the narrow portion of the "V" near the proximal end 110 at string cover 112. Consequently, string cover 112 may optionally be narrower near the proximal end 110.

When in the drawn configuration shown in FIGS. 4-9, tension forces on the draw string 132 on opposite sides of the string carrier 130 are substantially the same, resulting in increased accuracy. In one embodiment, tension forces draw string 132 on opposite sides of the string carrier can be within less than about 1.0%, and more preferably less than about 0.5%, and most preferably less than about 0.1%. Consequently, cocking and firing the crossbow 100 is highly repeatable. To the extent that manufacturing variability creates inaccuracy in the crossbow 100, any such inaccuracy is likewise highly repeatable, which can be compensated for with appropriate windage and elevation adjustments in the scope 116. The repeatability provided by the present string carrier 130 results in a highly accurate crossbow 100 at distances beyond the capabilities of prior art crossbows.

Additionally, it will be noted from FIG. 9, that when crossbow 100 is in the drawn, draw string 132 exhibits an included angle 135. The included angle 135 is the angle defined by the draw string 132 on either side of the string carrier 130 when drawn. The included angle 135 is preferably less than about 10 degrees, and more preferably less than about 7 degrees. In the illustrated embodiment, the included angle 135 in the drawn configuration is typically between about 3 degrees to about 7 degrees. In some instances, the sting portions on either side may be parallel to one another along the center rail 102. For example, a first portion of the draw string 132 that extends from the cam 142A to the catch may be parallel with a second portion of the draw string that extends from the cam 142B to the catch. In other word, portions of the draw string 132 may be parallel along the length of the center rail 102.

The string carrier 130 includes a catch that engages a narrow segment of the draw string 132 and permits the included angle 135. The included angle 135 that results from the narrow cam gap 149 between the tangent points 147 does not provide sufficient space to accommodate conventional cocking mechanisms, such as cocking ropes and cocking sleds disclosed in U.S. Pat. No. 6,095,128 (Bednar); U.S. Pat. No. 6,874,491 (Bednar); U.S. Pat. No. 8,573,192 (Bednar et al.); U.S. Pat. No. 9,335,115 (Bednar et al.); and 2015/0013654 (Bednar et al.), which are hereby incorporated by reference. It will be appreciated that the cranking systems disclosed herein are applicable to any type of crossbow, including recurved crossbows that do not include cams or conventional compound crossbows with power cables that crossover.

When draw string 132 is released by string carrier 130, potential energy is released from limbs 120 as limbs 120 separate. This separation compels cams 142 to rotate rapidly to pay out lengths of power cables 150 stored on string guides 152. This, in turn causes the predetermined lengths of draw string 132 to be wound onto the draw string journals 8A and 148B.

It will be noted from FIGS. 10 and 11, however, that cams 142 have a draw string journals 148A and 148B that expose draw string 132 to a range of different radiuses representatively illustrated as R1-R6. Accordingly, as cams 142 rotate the relative position of the tangent points 147 at which draw string 132 engages draw string journals 148A and 148B changes. This in turn allows for controlled variation of the cam gap distance 149 during cocking, firing and decocking.

As is shown in FIGS. 10-13, cams 142A and 142B have draw string journals 148A and 148B that engage draw string 132 over a range of different radiuses representatively illustrated as R1-R6 configured so that portions of draw string journals 148A and 148B that are positioned at the tangent points 147 at a time of firing have radius for example R1 that is comparatively larger than later radiuses R2-R6 to which draw string 132 will be exposed. Here there is a progressive reduction in radius from R2-R6 during firing.

FIG. 14 shows a cross sectional view of crossbow 100 taken along line A-A of FIG. 4, showing the scope 116 and the string cover 112 removed, in an uncocked state, while FIG. 15 shows a top, left, back cut away view of crossbow 100 in an uncocked state. As can be seen in FIGS. 14 and 15, during firing limbs 120A and 120C laterally separate from limbs 120B and 120D. As cams 142A and 142B are mounted to limbs 120, cams 142A and 142B also separate. This has the effect of laterally displacing tangent points 147 and expanding cam gap 149. Substantially simultaneously cams 142A and 142B rotate to draw portions of draw string 132 onto draw string journals 148A and 148B. The inertia and drag of an arrow causes the draw string 132 to maintain a V shape as this occurs, the distance between the vertex of the V and the tangent points 147 closes as the arrow is thrust along center rail 102 toward distal end 106. This greatly increases the included angle 135 and an increasing proportion of the remaining unwound length of draw string 132 is consumed by the requirements of lateral translation from the vertex of the V shape in the draw string 132 to tangent points 147. Given that the radii R1-RG of the cams 142A, 142B become progressively larger in proportion to the cams 142A, 142 laterally expanding, the portions of the draw string 132 on either side of the string carrier 130 remain substantially parallel until the draw string 132 at the nocking location is about four inches from the unfired position (see FIG. 16). From this four-inch position to the fully fired (undrawn) condition, the included angle 135 greatly increases.

Thus, over much of these power stroke, the relative consumption of unwound draw string occasioned by lateral translation requirements is substantially lower than that of the consumption of unwound draw string occasioned by winding draw string onto cams 142A and 142B and the impact of such changes is limited. However, as the amount of draw string 132 remaining diminishes, the V shape widens, the included angle increases and the rate of consumption of remaining unwound draw string 132 needed for lateral translation approaches or can even exceed the rate of consumption of remaining unwound draw string 132 caused by rotation of cams 142A and 142B. This in turn can cause a substantial transitory increase in the tension in draw string 132. This can have a variety of unwelcome effects such as inducing oscillations in arrow 118, the so-called archer's paradox, or creating differences in the tension in draw string 132 one either side of the remaining V that can influence arrow trajectory. In cases where these problems can be minimized, the transitory nature of the increase in tension can cause accuracy problems through unpredictable irregularities in the extent and peak energies achieved.

However, in crossbow 100, cams 142A and 142B use the above described reduction in the radius of draw string journals 148A and 148B to address this issue in that through such reductions in radius the rate at which cams 142A and 142B consume unwound draw string during firing is downwardly adjusted so that the demands of lateral translation can be met without inducing significant transitory changes in energy applied to an arrow by draw string 132. By reducing the radius of draw string journals 148A and 148B during firing, less of the remaining committed length of draw string 132 is wound onto draw string paths 148 per unit of rotation of draw string journals 148A and 148B. In some instances, the draw string paths 148 are aligned, such as being coplanar, with the firing plane 125. The rate of reduction in radius is generally determined based in part upon expected commitment of remaining unwound portions of draw string 132 to lateral displacement during firing and is calibrated so that the acceleration provided by draw string 132 against arrow 118 follows a consistent pattern, for example, a monotonically increasing acceleration, a relatively constant acceleration. This allows a user to avoid sharp changes in acceleration which may cause energy to be lost in elastically deforming arrow 118 or which may not occur in a balanced fashion on both sides of arrow 118 thereby introducing variations in aim.

The reduction in the radius of draw string journals 148A and 148B can be used to address static string tension of draw string 132. By reducing the static string tension in draw string 132 at the start of the firing of crossbow 100, the amount of inertial energy remaining in draw string 132 after arrow 118 separates from draw string 132 is lower. This has the effect of reducing the noise generated by draw string 132 during firing and reducing the vibration and other effects experienced by crossbow 100 and a user of crossbow 100. Further, this configuration helps to extend the power stroke achievable from a given length of draw string 132 that can be paid out from cams 142A and 142B by providing a very narrow included angle. This reduces the amount of draw string used for lateral displacement relative to tangent points 147 so that less draw string payout is required to achieve a desired power stroke.

Additionally, in embodiments, cams 142A and 142B are designed and mounted to limbs 120 so that tangent points 147 are closer to distal end 106 when crossbow 100 is in the undrawn condition. This allows crossbow 100 to be made more compact without compromising the performance of crossbow 100. In particular, this helps to allow crossbow 100 to be made shorter while still supplying a desired power stroke as some of the length of draw required to provide the desired power stroke can be moved forward of free ends 122 of limbs 120 and the power cables without adding unnecessary structure or compromising the performance of crossbow 100.

As is also shown in FIG. 15, in this embodiment, an upper draw string path wall 155 and lower draw string path wall 157 are positioned apart from each other and on opposite sides of firing plane 125 and define a perimeter outside of the center rail. Upper draw string path wall 155 and lower string path wall 157 have sufficient separation to permit draw string 132 to pass between upper draw string wall 155 and lower draw string wall 157 as included angle 135 increases and the V shape widens at the end of the power stroke of draw string 132. During a first portion of the travel of draw string when fired, the draw string 132 moves along the firing plane 125 when the crossbow is fired, the bowstring remains within the width of the center rail 102. However, as draw string 132 continues to complete forward motion during firing, the draw string 132 can move in part within a width of the center rail and within a perimeter of the draw string path walls 155 and 157 during at least a second portion of this travel.

Shown in FIG. 15 are left side upper draw string wall 155B and lower draw string wall 157B in embodiments upper right side wall 155A and 157A can be provided that are substantially similar but reconfigured for use on right side of center rail 102.

FIG. 16 is a top partial view of crossbow 100 and shows draw string 132 at an early stage cocking of draw string 132. During cocking, the string carrier 130 slides forward along the center rail 102 toward the riser 104 to engage the draw string 132 while it is in a released configuration 134. It will be observed here that in this embodiment, the tangent points 147 are further toward distal end 106 than are the power cables and the free ends of limbs 120. By configuring crossbow 100 to permit tangent points 147 to be located ahead of free ends 122 of limbs 120, the overall length of crossbow 100 can be shortened while still providing desirable performance measures.

FIG. 17 shows a top, right, back perspective view of crossbow 100 with string cover 112 and other components removed to better illustrate the components being discussed with reference to this figure. As is shown in FIG. 17, crossbow 100 has screw shafts 202A and 202B that extend between distal end 106 and proximal end 110. In this embodiment of crossbow 100, end screw shafts 202A and 202B are pivotally mounted to center rail 102 by pivot mounts 204A and 204B at distal end 106 as will be described in greater detail below.

FIG. 18 is a top left back perspective cutaway view of the crossbow 100 showing one embodiment of pivot mounts 204A and 204B. In this embodiment pivot mounts 204A and 204B comprise sleeve bearings mounted to center rail 102 and screw shafts 202A and 202B have distal ends that are positioned in pivot mounts 204A and 204B. Also shown in FIG. 18 is one embodiment of an arrow rest 124. As can be seen in this embodiment, arrow rest 124 is mounted to center rail 102 and provides a first support 126A for a first journal surface 127A on one side of center rail 102 and a second support 126B supporting a second journal surface 127B on the other side of center rail 102.

String carrier 130 is operatively coupled to screw shafts 202A, 202B ("202") by threaded couplings 201A and 201B as is shown in FIG. 14. Rotation of the screw shafts 202 causes the string carrier 130 to move back and forth along the center rail 102. As illustrated in FIG. 17, screw shafts 202A and 202B extend at distal end past the draw string 132 when in the released configuration 134, permitting the string carrier 130 to capture the draw string 132. A cranking system 200 can be operated electrically using motor 210 and battery pack 206 or manually by inserting a cocking handle into recess 208.

The string carrier 130 is preferably captured by the center rail 102 and moves in a single degree of freedom along a Y-axis. The engagement of string carrier 130 with center rail 102 substantially prevents the string carrier 130 from moving in the other five degrees of freedom (X-axis, Z-axis, pitch, roll, or yaw) relative to the center rail 102 and the riser 104. Center rail 102, string carrier 130, draw string 132, and cams 142A and 142B are configured so that draw string 132 remains substantially in a plane as string carrier 130 moves between the drawn configuration 136 and the released configuration 134. As used herein, "captured" refers to a string carrier 130 that cannot be removed from the center rail 102 without disassembling the crossbow 100 or the string carrier 130.

FIG. 19 shows a cross sectional view of crossbow 100 taken along line B-B of FIG. 17, showing one embodiment of features of crossbow 100 that can be used to effect at least part of the capture of string carrier 130. In this embodiment, center rail 102 has side bearing paths 206A and 206B and a lower bearing pocket 207 that extends from a proximal end 110 of crossbow 100 toward distal end 106 generally in a plane that is substantially parallel with the plane of screw shafts 202A and 202B and with draw string 132 respectively. The lower bearing pocket 207 may be formed into the center rail 102. In embodiments, the path of travel of travel of string carrier 130 can between a cocking position and a firing position can be controlled through the placement of positive stops in string carrier side paths that prevents the string carrier 130 from being moved past the cocked position or past the cocking position from which the process of moving string carrier 130 and draw string 132 to the firing position can begin. In embodiments string carrier 130 may have more than one string carrier side bearings 206A or 206B arranged in a planar configuration along the length of string carrier 130. Similarly one or more string carrier lower bearing can be used to the extent that one can be provided without interfering with other operations of string carrier 130.

FIGS. 20, 21, and 22 illustrate the cranking system 200 with a cheek rest 212, gear box cover 218 and butt plate 216 (FIG. 17) as well as other components removed to enhance and better illustrate the components being described. Gear box cover 218 includes telescoping butt plate mounts 220 (FIG. 21) that permits the position of the butt plate 216 to be adjusted along the Y-axis of the crossbow 100. A pair of support plates 222 mounted to the gear box cover 218 support axle 224 containing bevel gears 226. Rotation of the axle 224 with a cocking handle (not shown) but that can be plugged into crank port 214 formed in axle 224 or mechanically connected to axle 224 such that rotating a connected handle applies force urging axle 224 to rotate such that the bevel gear 226 is caused to rotate intermediate bevel gear 228 (see FIG. 22). Alternatively, motor 210 can be positioned to engage a motor port 215 shown (see FIG. 23) to apply forces urging motor gear 234 to rotate (See FIG. 20). Such forces urges intermediate spiral gear 230 to rotate. The motor 210 is preferably torque limited to limit the amount of torque applies to the cranking system 200.

As best illustrated in FIG. 22 the intermediate bevel gear 228 is keyed to axle 232. Intermediate spiral gear 230 is coupled to axle 232 by an intermediate spiral gear clutch system 231 (see FIG. 24) that limits the torque that can be applied by the intermediate spiral gear 230 to the spiral gears 240 coupled to the screw shafts.

FIGS. 21 and 22 illustrate the cranking system 200 with additional components hidden to best illustrate operation. In practice, the components joined to screw shafts 202A and 202B, are substantially identical, however, for the sake of clarity and brevity, some components that are shown in FIG. 23 on screw shaft 202A are not shown on screw shaft 202B. Moving from left to right, bearings 225 supports the screw shafts 202 radially, but do not restrict axial movement of the screw shafts 202. Thrust washers 256 used in conjunction with thrust needle bearings 257 provide low friction bearing for axial loads. Timing mechanisms 265 includes screw shims 254 and set screws 258. The screw shims 254 can be rotated during assembly of the crossbow 100 to synchronize the timing of the screw shafts 202 and fixed by use of set screws 258.

A pair of Belleville springs 252 are located between the screw shims 254 and spiral gears 240. Screw shaft keys 250 provide radial coupling between the spiral gears 240 and the screw shafts 202. The screw shaft keys 250 permit axial movement of the spiral gears 240 relative to the screw shafts 202. The spring force of the Belleville springs 252 serve to bias the spiral gears 240 rearward in direction 262 toward brake washers 248. The brake washers 248 are radially coupled to the screw shafts 202 by the screw shaft keys 250 so as to permit axial movement.

Friction washers 249 are interposed between the brake washers 248 and brake discs 251. The friction washers 249 provide friction torque between the brake washers 248 and the brake discs 251 when radial displacement occurs between the same. Portions 253 of the brake discs 251 are coupled to one-way bearings 242, which are secured in sleeves 244. The thrust needle bearings 257 and thrust washers 256 are located between the sleeves 244 and the brake discs 251 provide low friction bearing for axial loads on the brake discs 251.

The Belleville springs 252, spiral gears 240, brake washers 248, friction washers 249 and brake disc 251 may be configured, in embodiments, to operate as a mechanical clutch. In such an embodiment, mechanical clutch decouples the one-way bearings 242 from the spiral gears 240 to permit opposite rotation of the screw shafts 202 so the string carrier 130 can be moved toward the distal end 106 of the crossbow 100.

The one-way bearings 242 permit free rotation of the brake discs 251 in the cocking direction only, but prevents any rotation of the brake discs 251 in the de-cocking direction. Adjustment screws 255 compress the sleeve 244 against the stack (251, 249, 248, 240) to adjust the preload on the Belleville springs 252 as a means of presetting brake torque.

When cocking the crossbow 100, the one-way bearings 242 turns freely. When in the drawn configuration 136, the one-way bearings 242 and brake discs 251 impart sufficient friction to the screw shafts 202 to retain the string carrier 130 in the retracted position 160, notwithstanding the force applied by the draw string 132 and the limbs 120. No other mechanism is required to retain the string carrier 130 in the retracted position 160 (or anywhere along the length of the center rail 102). If the user releases the cocking handle at any time during cocking or de-cocking of the crossbow 100, the one-way bearings 242 and friction between the brake discs 251 and the brake washers 248 is sufficient to retain the cranking system 200 in its current position.

In the event the user wishes to manually de-cock the crossbow 100, force applied to the cocking handle rotates the intermediate spiral gear 230 in the opposite direction. The angled teeth on the intermediate spiral gear 230 apply an axial force on the mating angled teeth of the spiral gears 240, creating an axial force on the spiral gears 240 in opposite direction 263 which compresses the Belleville springs 252. Shifting the spiral gears 240 in the direction 263 reduces or eliminates the fiction between the brake discs 251 and the brake washers 248 a sufficient amount to permit the screw shafts 202 to rotate in the opposite direction, de-cocking the crossbow 100. In another embodiment, the clutch can be manually decoupled, such as with a release lever, such as the cranking system release disclosed in U.S. Pat. No. 10,209,026 (previously incorporated by reference). It will be appreciated that the present cranking system 200 may be used with virtually any crossbow, including without limitation the crossbows disclosed in U.S. Pat. Nos. 10,209,026.

FIG. 23 shows a partial left side cross-section view of cranking system 200 having an intermediate spiral gear clutch system 231 while FIG. 24 illustrates an exploded view of the spiral gear clutch system 231. In this embodiment, intermediate spiral gear 230 has a radial surface 264 with a central axle mount 266 allowing intermediate spiral gear 230 to rotate generally freely about axle 232 and a plurality of roller mounts 268 formed in radial surface 264. Roller mounts 268 are generally sized and shaped in part to receive rollers 270. A clutch index 280 is positioned on a side of rollers 270 opposite from radial surface 264. Clutch index 280 also has a radially extending surface 282 with an axle mount 284 featuring key tabs 287 sized and shaped to be inserted into one or more first keyways 235 on axle 232. Clutch index 280 further comprises a plurality of roller holders 288 shaped and positioned on radially extending surface 282 to cooperate with roller mounts 268 to hold rollers 270 therebetween. A thrust washer 290 and spring washer 300 are positioned on axle 232 between clutch index 280 and a nut 310. Nut 310 is tightened onto a thread 238 on axle 232 so as to compress thrust washer 290 and spring washer 300 creating a clamping pressure that biases clutch index against rollers 270 and that biases intermediate spiral gear 230 against stop 236.

When torque is applied to axle 232, roller holders 288 exert forces urging rollers 270 to rotate. The curved surfaces of the rollers 270 causes a first portion of the energy from the applied torque to be exerted radially against roller mounts 268 urging intermediate spiral gear 230 to rotate and a second portion of the energy from the applied torque to urge movement of clutch index 280 axially toward thrust washer 290 and spring washer 300. This has the effect of reducing the clamping force between intermediate spiral gear 230 and clutch index 280. Rollers 270, roller mounts 268, roller holders 288, are sized and shaped, and thrust washer 290 and spring washer 300 are designed so that when nut 310 is tightened to a predetermined tightness, the clamping force is sufficient to hold rollers 270, roller mounts 286 and roller holders 288 remain generally stationary relative to each other within a range of torques applied to axle 232.

However, these components are also selected and configured so that when the range of torques is exceeded, the portion of the energy from the applied torque urging movement of clutch index 280 axially toward thrust washer 290 and spring washer 300 reduces the clamping pressure against rollers to the point where the roller holders 288 of clutch index 280 can separate from the rollers 270 allowing clutch index 280 to rotate relative to rollers 270 and roller mounts 268. The rollers 270 stay in the roller holders 288 of the clutch index 280. Further, the clutch index 280 may be positioned between the spiral gear 230 and the thrust washer 290 but may not be axially loaded in the stack. As such, the thrust washer may experience a radial load. When the clutch breaks free, the rollers 270 may separate from the roller mounts 268 and stay in the roller holders 288 of the clutch index 280. This disrupts the transfer of force between axle 232 and intermediate spiral gear 230, thereby limiting the amount of energy that can be transferred through intermediate spiral gear clutch system 231.

Clutch index 280 continues to rotate until torque levels again return to the predetermined range allowing roller holders 288 to again engage the rollers 270 and permitted the transfer of energy to intermediate spiral gear 230.

It will be appreciated that this form of clutch operates with relatively little noise both when engaging and disengaging as there is very little movement of componentry necessary to engage and disengage and that such components, in this embodiment, contained within the innermost portions of cranking system 200. Additionally, in this embodiment, intermediate spiral gear clutch system 231 is contained substantially within a width of intermediate spiral gear 230 further containing any noise created by use and permitting cranking system 200 to be made compact. Further, this approach allows for high levels of precision and flexibility in setting torque levels and allows the separation of intermediate spiral gear 230 from axle 232 for brief periods of rotation so that transient increases in torque can be addressed without significant interruption in operations.

The present cranking mechanism 200 is highly repeatable, increasing the accuracy of the present crossbow 100. By contrast, conventional cocking ropes, cocking sleds and hand-cocking techniques lack the repeatability of the present string carrier 130, resulting in reduced accuracy. Windage and elevation adjustments cannot adequately compensate for random variability introduced by prior art cocking mechanism.

Non-photographic representations of draw string 132 and power cables 150A, 150B, 150C, and 150D are for discussion purposes and are not intended to represent the appearance or scale of these elements.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the various methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments are possible. Although the description above contains much specificity, these should not be construed as limiting the scope of the disclosure, but as merely providing illustrations of some of the presently preferred embodiments. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form varying modes disclosed. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

What is claimed is:

1. A crossbow, comprising:

a string latch;

a center rail providing an arrow support configured to position an arrow within a firing plane;

a riser coupled to the center rail, the riser configured to:

position fixed ends of a first flexible upper side limb and a second flexible upper side limb such that free ends of the first flexible upper side limb and the second flexible upper side limb flex along an upper plane disposed above the firing plane, and position fixed ends of a first flexible lower side limb and a second flexible lower side limb such that free ends of the first flexible lower side limb and the second flexible lower side limb flex along a lower plane disposed below the firing plane;

a first cam assembly coupling the free ends of the first flexible upper side limb and the first flexible lower side limb on a first side of the center rail, the first cam assembly comprising:

a first draw string path substantially co-planar with the firing plane, a first upper string journal disposed above the first draw string path, and a first lower string journal disposed below the first draw string path;

a second cam assembly coupling the free ends of the second flexible upper side limb and the second flexible lower side limb on a second side of the center rail, the second cam assembly comprising:

a second draw string path substantially co-planar with the firing plane, a second upper string journal disposed above the second draw string path, and a second lower string journal disposed below the second draw string path;

a draw string having a first end coupled to the first cam assembly along the first draw string path, and a second end coupled to the second cam assembly along the second draw string path, the draw string extending across the center rail along the firing plane and selectively engaged with the string latch;

a first upper power cable having a first end operatively coupled to the first upper string journal, and a second end operatively coupled to the free end of the second flexible upper side limb, the first upper power cable extending above the center rail and the firing plane;

a second upper power cable having a first end operatively coupled to the second upper string journal, and a second end operatively coupled to the free end of the first flexible upper side limb, the second upper power cable extending above the center rail and the firing plane;

a first lower power cable having a first end operatively coupled to the first lower string journal, and a second end operatively coupled to the free end of the second flexible lower side limb, the first lower power cable extending below the center rail and the firing plane; and a second lower power cable having a first end operatively coupled to the second lower string journal, and a second end operatively coupled to the free end of the first flexible lower side limb, the second lower power cable extending below the center rail and the firing plane.

2. The crossbow of claim 1, wherein:

the draw string includes a de-cocked position and a cocked position;

in the cocked position, the first upper power cable and the second upper power cable extend above the center rail at a first location between the string latch and the draw string;

in the de-cocked position, the first upper power cable and the second upper power cable extend above the center rail at a second location between the string latch and the draw string;

in the cocked position, the first lower power cable and the second lower power cable extend below the center rail at a third location between the string latch and the draw string; and in the de-cocked position, the first lower power cable and the second lower power cable extend below the center rail at a fourth location between the string latch and the draw string.

3. The crossbow of claim 1, further comprising a string carrier including the string latch, wherein:

the draw string is moveable between a de-cocked position and a cocked position;

the string carrier is moveable between a capture position and a firing position; and the string carrier is movable along a length of the center rail, between the capture position where the string carrier engages the draw string in the de-cocked position, and the firing position where the string carrier moves the draw string to the cocked position.

4. The crossbow of claim 3, wherein:

the string carrier includes a height; and the first upper power cable and the second upper power cable are separated from the first lower power cable and the second lower power cable by a distance that is greater than the height to allow the string carrier to pass therebetween.

5. The crossbow of claim 1, wherein:

the crossbow is moveable between a drawn position and a released position;

the center rail has a first side, a second side, and a width extending between the first side and the second side; and when the crossbow is in the drawn position, at least a first portion of the first cam assembly and at least a second portion of the second cam assembly reside above the center rail, within the width.

6. The crossbow of claim 5, wherein:

in the drawn position, a first tangential point of the first draw string path is located above the center rail;

in the drawn position, a second tangential point of the second draw string path is located above the center rail; and a gap between the first tangential point and the second tangential point is less than about 2 inches.

7. The crossbow of claim 1, wherein at least one of:

the first upper power cable unwraps from the first upper string journal as the draw string moves between a drawn position to a released position;

the second upper power cable unwraps from the second upper string journal as the draw string moves between the drawn position to the released position;

the first lower power cable unwraps from the first lower string journal as the draw string moves between the drawn position to the released position; or the second lower power cable unwraps from the second lower string journal as the draw string moves between the drawn position to the released position.

8. The crossbow of claim 1, wherein at least one of:

the first cam assembly rotates at least 270 degrees as the crossbow is drawn from a released position to a drawn position; or the second cam assembly rotates at least 270 degrees as the crossbow is drawn from the released position to the drawn position.

9. The crossbow of claim 1, further comprising:

a string carrier received within the center rail and including the string latch, the string carrier being configured to slide towards a distal end of the center rail to engage with the draw string in a de-cocked position, and slide towards a proximal end of the center rail to a cocked position; and at least one screw shaft is coupled to the center rail and coupled to the string carrier, wherein rotation of the at least one screw shaft moves the string carrier along the center rail in a direction towards the cocked position.

10. The crossbow of claim 9, further comprising a cocking mechanism coupled to the proximal end of the center rail that rotates the at least one screw shaft to move the string carrier along the center rail in the direction towards the cocked position, the cocking mechanism comprising:

a one-way bearing that permits free rotation of the at least one screw shaft in response to rotation of a cocking handle in a first direction to move the string carrier in the direction towards the cocked position, and inhibits rotation of the at least one screw shaft in a second direction such that the string carrier is retained in a current location during release of the cocking handle; and a mechanical clutch that selectively decouples the one-way bearing from the at least one screw shaft to permit rotation of the at least one screw shaft in response to rotation of the cocking handle in the second direction to move the string carrier toward the de-cocked position.

11. The crossbow of claim 10, wherein rotation of the cocking handle in the second direction decouples the one-way bearing from the at least one screw shaft.

12. The crossbow of claim 11, wherein the cocking mechanism comprises:

a first screw shaft;

a second screw shaft; and a timing mechanism that synchronizes rotation of the first screw shaft and the second screw shaft.

13. A crossbow, comprising:

a center rail configured to receive an arrow;

a riser coupled to the center rail;

a first flexible limb located on a first side of the center rail, the first flexible limb including a first end coupled to the riser and a second end spaced apart from the first end;

a second flexible limb located on the first side of the center rail, the second flexible limb including a third end coupled to the riser and a fourth end spaced apart from the third end;

a third flexible limb located on a second side of the center rail, the third flexible limb including a fifth end coupled to the riser and a sixth end spaced apart from the fifth end;

a fourth flexible limb located on the second side of the center rail, the fourth flexible limb including a seventh end coupled to the riser and an eighth end spaced apart from the seventh end;

a first cam assembly coupled to the first flexible limb at the second end and the second flexible limb at the fourth end, the first cam assembly including:

a first draw string journal, a first power cable journal disposed on a first side of the first draw string journal, and a second power cable journal disposed on a second side of the first draw string journal;

a second cam assembly coupled to the third flexible limb at the fifth end and the fourth flexible limb at the eighth end, the second cam assembly including:

a second draw string journal, a third power cable journal disposed on a first side of the second draw string journal, and a fourth power cable journal disposed on a second side of the second draw string journal;

a draw string at least partially received in the first draw string journal and the second draw string journal;

a first power cable coupled to the second end of the first flexible limb and received at least partially within the third power cable journal;

a second power cable coupled to the sixth end of the third flexible limb and received at least partially within the first power cable journal;

a third power cable coupled to the fourth end of the second flexible limb and received at least partially within the fourth power cable journal; and a fourth power cable coupled to the eighth end of the fourth flexible limb and received at least partially within the second power cable journal.

14. The crossbow of claim 13, wherein:

the draw string is disposed along a firing plane;

the first power cable and the second power cable are disposed above the firing plane; and the third power cable and the fourth power cable are disposed below the firing plane.

15. The crossbow of claim 13, wherein:

the crossbow is moveable between a drawn position and a retracted position;

the center rail includes a width; and in the drawn position, a first edge of the first draw string journal is separated from a second edge of the second draw string journal by a distance that is less than the width.

16. The crossbow of claim 15, wherein:

the center rail includes a longitudinal axis;

in the drawn position, an included angle is disposed between the longitudinal axis and the draw string; and the included angle is less than about 7 degrees.

17. The crossbow of claim 13, further comprising:

a string carrier configured to engage the draw string;

at least one screw shaft coupled the string carrier; and a cocking mechanism that rotates the at least one screw shaft to move the string carrier along the center rail towards a retracted position, the cocking mechanism including:

a one-way bearing that permits free rotation of the at least one screw shaft in response to rotation of a cocking handle in a first direction to move the string carrier toward the retracted position, and inhibits rotation of the at least one screw shaft in response to rotation of the cocking handle in a second direction such that the string carrier is retained in a current location during release of the cocking handle, and a mechanical clutch that selectively decouples the one-way bearing from the at least one screw shaft to permit rotation of the at least one screw shaft in response to rotation of the cocking handle in the second direction to move the string carrier toward the retracted position.

18. A crossbow, comprising:

a center rail;

a riser coupled to the center rail;

a first flexible limb including a first end coupled to the riser;

a second flexible limb including a second end coupled to the riser;

a third flexible limb including a third end coupled to the riser;

a fourth flexible limb including a fourth end coupled to the riser;

a first cam assembly coupled to the first flexible limb and the second flexible limb, the first cam assembly including:

a first draw string journal, a first power cable journal disposed on a first side of the first draw string journal, and a second power cable journal disposed on a second side of the first draw string journal;

a second cam assembly coupled to the third flexible limb and the fourth flexible limb, the second cam assembly including:

a second draw string journal, a third power cable journal disposed on a first side of the second draw string journal, and a fourth power cable journal disposed on a second side of the second draw string journal;

a draw string at least partially received in the first draw string journal and the second draw string journal;

a first power cable that crosses over the center rail above the draw string, the first power cable being coupled to the first flexible limb and received at least partially within the third power cable journal;

a second power cable that crosses over the center rail above the draw string, the second power cable being coupled to the third flexible limb and received at least partially within the first power cable journal;

a third power cable that crosses over the center rail below the draw string, the third power cable being coupled to the second flexible limb and received at least partially within the fourth power cable journal; and a fourth power cable that crosses over the center rail below the draw string, the fourth power cable being coupled to the fourth flexible limb and received at least partially within the second power cable journal.

19. The crossbow of claim 18, further comprising:

a string carrier configured to engage the draw string;

at least one screw shaft coupled the string carrier; and a cocking mechanism that rotates the at least one screw shaft to move the string carrier along the center rail towards a retracted position, the cocking mechanism including:

a one-way bearing that permits free rotation of the at least one screw shaft in response to rotation of a cocking handle in a first direction to move the string carrier toward the retracted position, and inhibits rotation of the at least one screw shaft in response to rotation of the cocking handle in a second direction such that the string carrier is retained in a current location during release of the cocking handle, and a mechanical clutch that selectively decouples the one-way bearing from the at least one screw shaft to permit rotation of the at least one screw shaft in response to rotation of the cocking handle in the second direction to move the string carrier toward a released position.

* * * * *